US010982868B2

(12) United States Patent
Grabowski et al.

(10) Patent No.: US 10,982,868 B2
(45) Date of Patent: Apr. 20, 2021

(54) HVAC EQUIPMENT HAVING LOCATING SYSTEMS AND METHODS

(71) Applicant: Johnson Controls Technology Company, Plymouth, MI (US)

(72) Inventors: Adam Grabowski, Brookfield, WI (US); Michael J. Zummo, Milwaukee, WI (US); Nicole Ann Madison, Milwaukee, WI (US); Michael F. Kornacki, Oak Creek, WI (US)

(73) Assignee: Johnson Controls Technology Company, Auburn Hills, MI (US)

( * ) Notice: Subject to any disclaimer, the term of this patent is extended or adjusted under 35 U.S.C. 154(b) by 864 days.

(21) Appl. No.: 15/146,519

(22) Filed: May 4, 2016

(65) Prior Publication Data

US 2016/0327293 A1 Nov. 10, 2016

Related U.S. Application Data

(60) Provisional application No. 62/156,854, filed on May 4, 2015.

(51) Int. Cl.

| | |
|---|---|
| ***F24F 11/00*** | (2018.01) |
| ***F24F 11/50*** | (2018.01) |
| ***F24F 11/30*** | (2018.01) |
| ***F24F 11/62*** | (2018.01) |
| *F24F 11/52* | (2018.01) |

(Continued)

(52) U.S. Cl.

CPC ..... *F24F 11/30* (2018.01); *F24F 11/62* (2018.01); *F24F 11/52* (2018.01); *F24F 11/65* (2018.01); *F24F 2110/00* (2018.01)

(58) Field of Classification Search

CPC ..... F24F 11/001; F24F 2011/0068; F24F 2011/0069; G01S 19/14; G01S 19/46

USPC ..... 340/8.1

See application file for complete search history.

(56) References Cited

U.S. PATENT DOCUMENTS

| | | | |
|---|---|---|---|
| 6,745,027 | B2 | 6/2004 | Twitchell, Jr. |
| 6,879,913 | B1 | 4/2005 | Yu |
| 6,934,540 | B2 | 8/2005 | Twitchell, Jr. |

(Continued)

FOREIGN PATENT DOCUMENTS

| | | |
|---|---|---|
| CA | 2777693 | 1/2013 |
| CN | 102214000 | 10/2011 |

(Continued)

OTHER PUBLICATIONS

"Samsung to Acquire CSR for its Indoor GPS technology", Indoor LBS online blog, Jul. 16, 2012, retrieved from the internet at: http://indoorlbs.blogspot.com/2012/07/samsung-to-acquire-csr-for-indoor-gps.html on Aug. 7, 2014, 1 page as printed.

(Continued)

*Primary Examiner* — Nelson J Nieves
*Assistant Examiner* — Meraj A Shaikh
(74) *Attorney, Agent, or Firm* — Foley & Lardner LLP

(57) ABSTRACT

Systems and methods for locating building equipment in a building management system (BMS) are provided. An HVAC system includes an HVAC controller and an HVAC device. The HVAC device includes processing circuit including a memory and a processor. The processing circuit automatically determining a location of the HVAC device reporting the location of the HVAC device to the HVAC controller.

21 Claims, 15 Drawing Sheets

(51) Int. Cl.
*F24F 11/65* (2018.01)
*F24F 110/00* (2018.01)

(56) References Cited

U.S. PATENT DOCUMENTS 7,133,704 B2 11/2006 Twitchell, Jr.
7,155,264 B2 12/2006 Twitchell, Jr.
7,200,132 B2 4/2007 Twitchell, Jr.
7,209,468 B2 4/2007 Twitchell, Jr.
7,209,771 B2 4/2007 Twitchell, Jr.
7,221,668 B2 5/2007 Twitchell, Jr.
7,378,957 B2 5/2008 Twitchell, Jr.
7,378,958 B2 5/2008 Twitchell, Jr.
7,378,959 B2 5/2008 Twitchell, Jr.
7,391,321 B2 6/2008 Twitchell, Jr.
7,394,361 B1 7/2008 Twitchell, Jr.
7,430,437 B2 9/2008 Twitchell, Jr.
7,438,334 B2 10/2008 Terry et al.
7,522,568 B2 4/2009 Twitchell, Jr.
7,526,381 B2 4/2009 Twitchell, Jr.
7,529,547 B2 5/2009 Twitchell, Jr.
7,535,339 B2 5/2009 Twitchell, Jr.
7,538,656 B2 5/2009 Twitchell, Jr.
7,538,657 B2 5/2009 Twitchell, Jr.
7,538,658 B2 5/2009 Twitchell, Jr.
7,539,520 B2 5/2009 Twitchell, Jr.
7,542,849 B2 6/2009 Twitchell, Jr.
7,554,442 B2 6/2009 Twitchell, Jr.
7,563,991 B2 7/2009 Twitchell et al.
7,570,208 B2 8/2009 Wang et al.
7,574,168 B2 8/2009 Twitchell et al.
7,574,300 B2 8/2009 Twitchell et al.
7,583,769 B2 9/2009 Twitchell et al.
7,650,135 B2 1/2010 Twitchell
7,705,747 B2 4/2010 Twitchell, Jr.
7,733,818 B2 6/2010 Twitchell, Jr.
7,733,944 B2 6/2010 Twitchell et al.
7,742,744 B2 6/2010 Twitchell, Jr.
7,742,745 B2 6/2010 Twitchell, Jr.
7,742,772 B2 6/2010 Twitchell, Jr.
7,742,773 B2 6/2010 Twitchell, Jr.
7,746,838 B2 6/2010 Twitchell, Jr.
7,783,246 B2 8/2010 Twitchell et al.
7,822,551 B2 10/2010 Twitchell, Jr.
7,828,342 B2 11/2010 Terry et al.
7,828,343 B2 11/2010 Terry et al.
7,828,344 B2 11/2010 Terry et al.
7,828,345 B2 11/2010 Terry et al.
7,828,346 B2 11/2010 Terry et al.
7,830,273 B2 11/2010 Twitchell, Jr.
7,830,850 B2 11/2010 Twitchell, Jr.
7,830,852 B2 11/2010 Twitchell, Jr.
7,847,676 B2 12/2010 Twitchell, Jr.
7,883,126 B2 2/2011 Terry et al.
7,883,127 B2 2/2011 Terry et al.
7,883,128 B2 2/2011 Terry et al.
7,900,980 B2 3/2011 Terry et al.
7,904,071 B2 3/2011 Twitchell, Jr.
7,907,941 B2 3/2011 Twitchell, Jr.
7,912,644 B2 3/2011 Twitchell, Jr.
7,938,459 B2 5/2011 Terry et al.
7,940,716 B2 5/2011 Twitchell, Jr.
7,940,717 B2 5/2011 Twitchell, Jr.
7,940,719 B2 5/2011 Twitchell, Jr.
7,940,736 B2 5/2011 Twitchell, Jr.
7,941,095 B2 5/2011 Twitchell, Jr.
8,045,929 B2 10/2011 Twitchell, Jr.
8,050,625 B2 11/2011 Twitchell, Jr.
8,050,668 B2 11/2011 Twitchell, Jr.
8,068,807 B2 11/2011 Twitchell, Jr.
8,078,139 B2 12/2011 Twitchell, Jr.
8,095,070 B2 1/2012 Twitchell, Jr.
8,111,651 B2 2/2012 Twitchell, Jr.
8,144,671 B2 3/2012 Twitchell, Jr.
8,172,154 B1 5/2012 Figley et al.
8,204,439 B2 6/2012 Twitchell, Jr.
8,207,848 B2 6/2012 Berger et al.
8,218,514 B2 7/2012 Twitchell, Jr.
8,223,680 B2 7/2012 Twitchell, Jr.
8,238,826 B2 8/2012 Twitchell, Jr.
8,275,404 B2 9/2012 Berger et al.
8,279,067 B2 10/2012 Berger et al.
8,280,345 B2 10/2012 Twitchell, Jr.
8,284,045 B2 10/2012 Twitchell, Jr.
8,284,741 B2 10/2012 Twitchell, Jr.
8,300,551 B2 10/2012 Koop et al.
8,301,082 B2 10/2012 Twitchell, Jr.
8,315,237 B2 11/2012 Berger et al.
8,315,563 B2 11/2012 Twitchell, Jr.
8,315,565 B2 11/2012 Twitchell, Jr.
8,326,226 B2 12/2012 Twitchell, Jr.
8,331,862 B2 12/2012 Twitchell, Jr.
8,391,435 B2 3/2013 Farley et al.
8,427,508 B2 4/2013 Mattila et al.
8,433,309 B2 4/2013 Twitchell, Jr.
8,462,662 B2 6/2013 Robins
8,605,660 B2 12/2013 Twitchell, Jr.
8,705,523 B2 4/2014 Koop et al.
8,726,478 B2 5/2014 Twitchell et al.
8,755,787 B2 6/2014 Twitchell, Jr.
9,703,002 B1 * 7/2017 Olsson ..... H01M 2/105
2004/0256473 A1 12/2004 Hull et al.
2005/0215280 A1 9/2005 Twitchell, Jr.
2008/0111692 A1 5/2008 Twitchell
2008/0129458 A1 6/2008 Twitchell
2008/0143484 A1 6/2008 Twitchell
2008/0144554 A1 6/2008 Twitchell
2008/0212544 A1 9/2008 Twitchell
2008/0294291 A1 11/2008 Salsbury
2008/0303897 A1 12/2008 Twitchell, Jr.
2008/0304443 A1 12/2008 Twitchell, Jr.
2009/0016308 A1 1/2009 Twitchell, Jr.
2009/0026773 A1 1/2009 Terry et al.
2009/0129306 A1 5/2009 Twitchell et al.
2009/0267770 A1 10/2009 Twitchell, Jr.
2009/0283320 A1 11/2009 Twitchell et al.
2010/0007470 A1 1/2010 Twitchell, Jr.
2010/0070085 A1 3/2010 Harrod et al.
2010/0114383 A1 5/2010 Rosca et al.
2010/0121862 A1 5/2010 Twitchell, Jr.
2010/0130267 A1 5/2010 Twitchell, Jr.
2010/0141401 A1 6/2010 Twitchell, Jr.
2010/0145865 A1 6/2010 Berger et al.
2010/0214059 A1 8/2010 Twitchell, Jr.
2010/0214060 A1 8/2010 Twitchell, Jr.
2010/0214061 A1 8/2010 Twitchell et al.
2010/0214074 A1 8/2010 Twitchell, Jr.
2010/0214077 A1 8/2010 Terry et al.
2010/0219938 A1 9/2010 Twitchell, Jr.
2010/0219939 A1 9/2010 Twitchell, Jr.
2010/0231381 A1 9/2010 Twitchell, Jr.
2010/0250460 A1 9/2010 Twitchell, Jr.
2010/0260087 A1 10/2010 Twitchell, Jr.
2010/0298986 A1 * 11/2010 Stachler ..... H01R 13/6456
700/276
2010/0315260 A1 * 12/2010 Geiger ..... G01C 21/26
340/8.1
2010/0330930 A1 12/2010 Twitchell
2011/0006882 A1 1/2011 Twitchell, Jr.
2011/0047015 A1 2/2011 Twitchell, Jr.
2011/0071685 A1 3/2011 Huneycutt et al.
2011/0115816 A1 5/2011 Brackney
2012/0214515 A1 * 8/2012 Davis ..... G01S 5/22
455/456.3
2012/0310416 A1 12/2012 Tepper et al.
2013/0169681 A1 * 7/2013 Rasane ..... G06T 19/006
345/633
2013/0214939 A1 * 8/2013 Washlow ..... G01S 7/003
340/901
2014/0135042 A1 * 5/2014 Buchheim ..... G01S 1/68
455/456.6
2014/0309870 A1 * 10/2014 Ricci ..... H04W 4/21
701/36

(56) References Cited

U.S. PATENT DOCUMENTS

| | | | | |
|---|---|---|---|---|
| 2015/0219349 | A1* | 8/2015 | Means | F24F 11/30 701/484 |
| 2015/0312696 | A1 | 10/2015 | Ribbich et al. | |
| 2015/0327010 | A1 | 11/2015 | Gottschalk et al. | |
| 2016/0014558 | A1 | 1/2016 | Berlin et al. | |
| 2016/0225264 | A1* | 8/2016 | Taveira | G05D 1/102 |

FOREIGN PATENT DOCUMENTS

| | | |
|---|---|---|
| EP | 2 228 270 | 9/2010 |
| EP | 2 372 263 | 10/2011 |
| EP | 2 438 800 | 4/2012 |
| EP | 2 607 802 | 6/2013 |
| KR | 100538082 | 12/2005 |
| KR | 20110128096 | 11/2011 |
| KR | 20130053535 | 5/2013 |
| WO | WO-2010/141076 | 12/2010 |
| WO | WO-2013/049297 | 4/2013 |
| WO | WO-2013/089713 | 6/2013 |

OTHER PUBLICATIONS

Anthony, "Think GPS is cool? IPS will blow your mind", ExtremeTech, Apr. 24, 2012, retrieved from the internet at http://www.extremetech.com/extreme/126843-think-gps-is-cool-ips-will-blow-your-mind/2 on Aug. 7, 2014, 4 pages as printed.

Boogar, "Why Polestar's indoor GPS Technology 10 years in the making is the future of local commerce", Rude Baguette—online blog, Apr. 15, 2013, retrieved from the internet at http://www.rudebaguette.com/2013/04/15/why-polestars-indoor-gps-technology-10-years-in-the-making-is-the-future-of-local-commerce/ on Aug. 7, 2014, 3 pages as printed.

Broadcom Integrated Multi-Constellation GNSS Receiver BCM4752 Product Information Page, retrieved from the internet at http://www.broadcom.com/products/GPS/GPS-Silicon-Solutions/BCM4752 on Aug. 7, 2014, 1 page.

Murfin, "Indoor Location Breaking Through", GPS World—online, Apr. 17, 2013, retrieved from the internet at: http://gpsworld.com/indoor-location-breaking-through/ on Aug. 7, 2014, 3 pages as printed.

Non-Final Office Action on U.S. Appl. No. 14/272,150, dated Jun. 17, 2016, 39 pages.

Skeledzija et al., Smart Home Automation System for Energy Efficient Housing, IEEE, May 2014, pp. 166-177.

U.S. Department of Energy National Renewable Energy Laboratory, "Augmented Reality Building Operations Tool", retrieved from the internet at http://techportal.eere.energy.gov/technology.do/techID=540# on Aug. 7, 2014, 2 pages.

Ward-Bailey, "Indoor GPS: Why tech companies want to track you inside", The Christian Science Monitor—online, Mar. 28, 2013, retrieved from the internet at http://www.csmonitor.com/Innovation/Horizons/2013/0328/Indoor-GPS-Why-tech-companies-want-to-track-you-inside on Aug. 7, 2014, 2 pages.

* cited by examiner

HVAC EQUIPMENT HAVING LOCATING SYSTEMS AND METHODS

CROSS-REFERENCE TO RELATED APPLICATIONS

This application claims the benefit of and priority to U.S. Provisional Patent Application No. 62/156,854 filed May 4, 2015, the entirety of which is incorporated by reference herein.

BACKGROUND

The present invention relates generally to building management systems. The present invention relates more particularly to systems and methods for locating building equipment in a building management system.

A building management system (BMS) is, in general, a system of devices configured to control, monitor, and manage equipment in or around a building or building area. A BMS can include a heating, ventilation, and air conditioning (HVAC) system, a security system, a lighting system, a fire alerting system, another system that is capable of managing building functions or devices, or any combination thereof. BMS devices may be installed in any environment (e.g., an indoor area or an outdoor area) and the environment may include any number of buildings, spaces, zones, rooms, or areas. A BMS may include a variety of devices (e.g., HVAC devices, controllers, chillers, fans, sensors, etc.) configured to facilitate monitoring and controlling the building space. Throughout this disclosure, such devices are referred to as BMS devices or building equipment.

Locating building equipment is often the first step required to service, inspect, or repair the building equipment. For example, a service technician may arrive at a customer site for the purpose of repairing a faulty article of building equipment. Before the equipment can be serviced, the technician must locate the building equipment. Locating building equipment can be difficult when the service technician is unfamiliar with the building and/or if the building equipment is hidden or obstructed (e.g., behind a wall, above a ceiling tile, etc.).

SUMMARY

One implementation of the present disclosure is an HVAC system for installation in a building. The HVAC system includes an HVAC controller and an HVAC device. An HVAC system includes an HVAC controller and an HVAC device. The HVAC device includes processing circuit including a memory and a processor. The processing circuit automatically determining a location of the HVAC device reporting the location of the HVAC device to the HVAC controller.

Another implementation of the present disclosure is a system for locating building equipment in a building management system (BMS). The system includes a mobile device configured to request a location of a BMS device. The system further includes a device locating system configured to identify the location of the BMS device and to provide the location of the BMS device to the mobile device. The mobile device is configured to determine a location of the mobile device and to present an interface that displays the location of the BMS device relative to the location of the mobile device.

Another implementation of the present disclosure is a method for locating building equipment in a building management system (BMS). The method includes requesting a location of a BMS device using a mobile device. The method further includes determining a location of the mobile device and receiving a request for the location of the BMS device at a device locating system. The method further includes identifying a location of the BMS device using the device locating system, and transmitting the location of the BMS device to the mobile device from the device locating system. The method further includes determining a location of the BMS device relative to the location of the mobile device, the relative location displayed on an interface of the mobile device.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
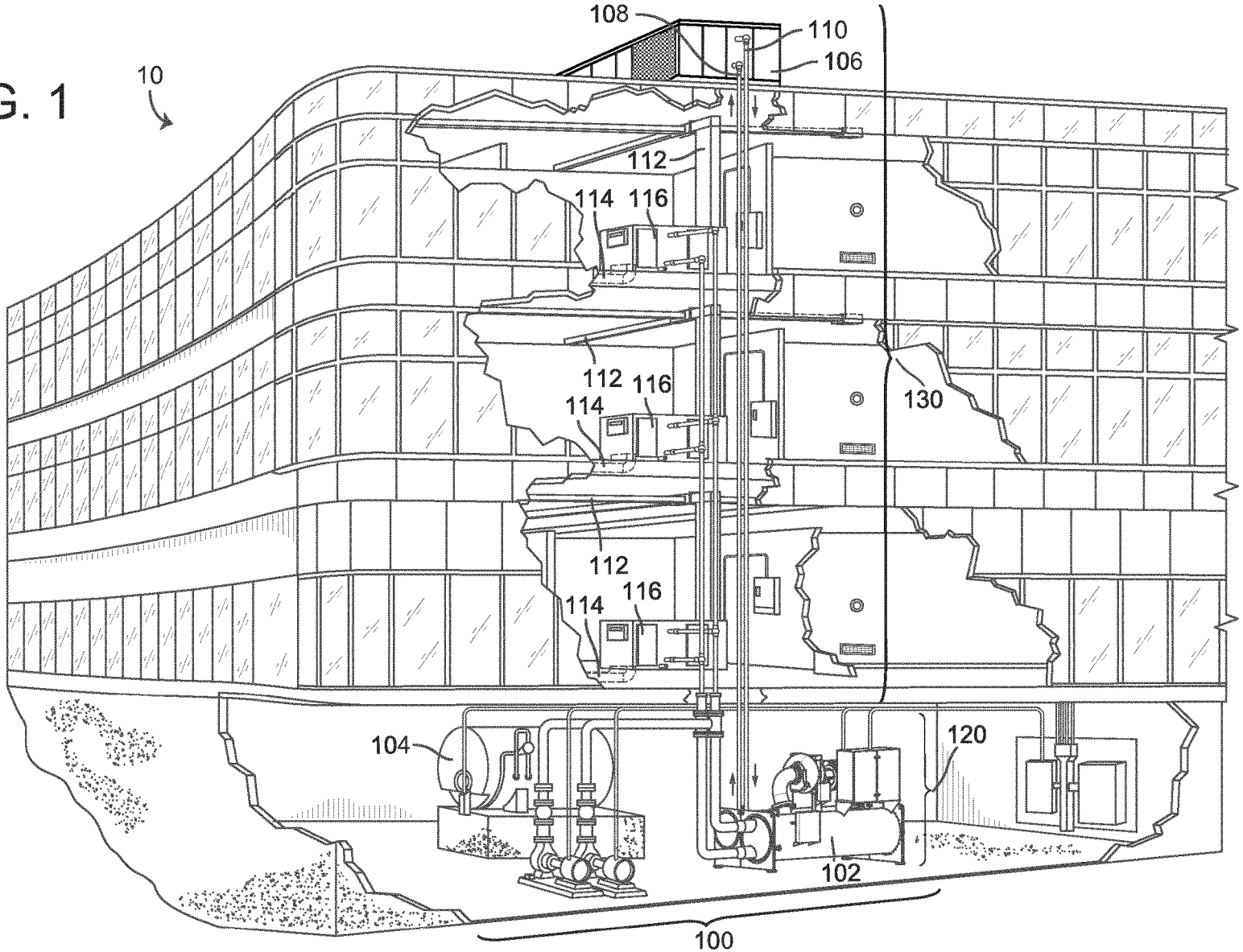
FIG. 1 is a drawing of a building equipped with a HVAC system, according to an exemplary embodiment.

Referring generally to the FIGURES, systems and methods for locating building equipment are shown, according to various exemplary embodiments. The systems and methods described herein may be used display the locations of building equipment on a mobile device (e.g., a tablet or smartphone operated by a service technician). The mobile device may include location-sensing electronics (e.g., a GPS device, an altimeter, etc.) configured to measure the location of the mobile device. In some embodiments, the mobile device runs an application configured to search a library BMS devices for a particular BMS device (e.g., by device name, by device type) or filter the library of devices based on user-selected device attributes. The library of BMS devices may include all of the BMS devices installed within a particular building or campus. In some embodiments, the application is configured to display a list of nearby BMS devices (e.g., based on the location of the mobile device). A user can select a particular BMS device via the searching interface.

The application may display the locations of both the mobile device and the selected BMS device. The location of the mobile device may be measured by integrated location electronics. The location of the selected BMS device may be retrieved from a locations database. Various interfaces may be generated to display the locations of the devices. For example, the application may display a street map that includes the location of the selected BMS device and the location of the mobile device (when the mobile device is not in the same building as the selected BMS device) or a floor plan that includes the location of the selected BMS device and the location of the mobile device (when the mobile device is in the same building or floor as the selected BMS device).

In some embodiments, the application displays an augmented reality view of the building. The augmented reality view may include the location of the BMS device projected upon or superimposed over a live camera-derived image (e.g., on the display of a user device). Advantageously, the augmented reality display may allow service personnel to quickly identify BMS devices present in a building, even through walls, floors, or ceilings. For example, a technician can point a mobile device with a camera (e.g., a smart phone, a tablet, etc.) toward a wall that has BMS devices located on the other side of the wall. The location of the BMS devices can be overlaid on the live camera view on the mobile device's display using the mobile devices internal peripherals (e.g. compass, accelerometer, etc.) and location data describing the location of the building equipment.

Various techniques may be used to determine the locations of the BMS devices (e.g., sensors, actuators, control devices, HVAC equipment, etc.) in or around a building. In some embodiments, an indoor positioning system is used to determine a three-dimensional location for the BMS devices based on the strength of wireless signals (e.g., Wi-Fi signals, Bluetooth signals, RFID signals, Zigbee signals, near field communication (NFC) signals, etc.) sent or received by the BMS devices. In other embodiments, BMS devices may be outfitted with a GPS device and/or an altimeter. The BMS devices may report GPS coordinates and/or altimeter measurements to the BMS. Alternatively, mobile devices can be used to measure GPS coordinates and/or altitude and can detect nearby BMS devices based on wireless signals provided by the BMS devices. Once the BMS devices have been located, the application may provide an interface for monitoring, controlling, or otherwise interacting with the BMS devices.

Building Management System and HVAC System

Referring now to FIGS. 1-4, an exemplary building management system (BMS) and HVAC system in which the systems and methods of the present invention may be implemented are shown, according to an exemplary embodiment. Referring particularly to FIG. 1, a perspective view of a building 10 is shown. Building 10 is served by a BMS. A BMS is, in general, a system of devices configured to control, monitor, and manage equipment in or around a building or building area. A BMS can include, for example, an HVAC system, a security system, a lighting system, a fire alerting system, or any other system that is capable of managing building functions or devices, or any combination thereof.

The BMS that serves building 10 includes an HVAC system 100. HVAC system 100 may include a plurality of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 may provide a heated or chilled fluid to an air handling unit of airside system 130. Airside system 130 may use the heated or chilled fluid to heat or cool an airflow provided to building 10. An exemplary waterside system and airside system which may be used in HVAC system 100 are described in greater detail with reference to FIGS. 2-3.

HVAC system 100 is shown to include a chiller 102, a boiler 104, and a rooftop air handling unit (AHU) 106. Waterside system 120 may use boiler 104 and chiller 102 to heat or cool a working fluid (e.g., water, glycol, etc.) and may circulate the working fluid to AHU 106. In various embodiments, the HVAC devices of waterside system 120 may be located in or around building 10 (as shown in FIG. 1) or at an offsite location such as a central plant (e.g., a chiller plant, a steam plant, a heat plant, etc.). The working fluid may be heated in boiler 104 or cooled in chiller 102, depending on whether heating or cooling is required in building 10. Boiler 104 may add heat to the circulated fluid, for example, by burning a combustible material (e.g., natural gas) or using an electric heating element. Chiller 102 may place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 may be transported to AHU 106 via piping 108.

AHU 106 may place the working fluid in a heat exchange relationship with an airflow passing through AHU 106 (e.g., via one or more stages of cooling coils and/or heating coils). The airflow may be, for example, outside air, return air from within building 10, or a combination of both. AHU 106 may transfer heat between the airflow and the working fluid to provide heating or cooling for the airflow. For example, AHU 106 may include one or more fans or blowers configured to pass the airflow over or through a heat exchanger containing the working fluid. The working fluid may then return to chiller 102 or boiler 104 via piping 110.

Airside system 130 may deliver the airflow supplied by AHU 106 (i.e., the supply airflow) to building 10 via air supply ducts 112 and may provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 may include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 may include various sensors (e.g., temperature sensors, pressure sensors, etc.) configured to measure attributes of the supply airflow. AHU 106 may receive input from sensors located within AHU 106 and/or within the building zone and may adjust the flow rate, temperature, or other attributes of the supply airflow through AHU 106 to achieve setpoint conditions for the building zone.

Figure 2:
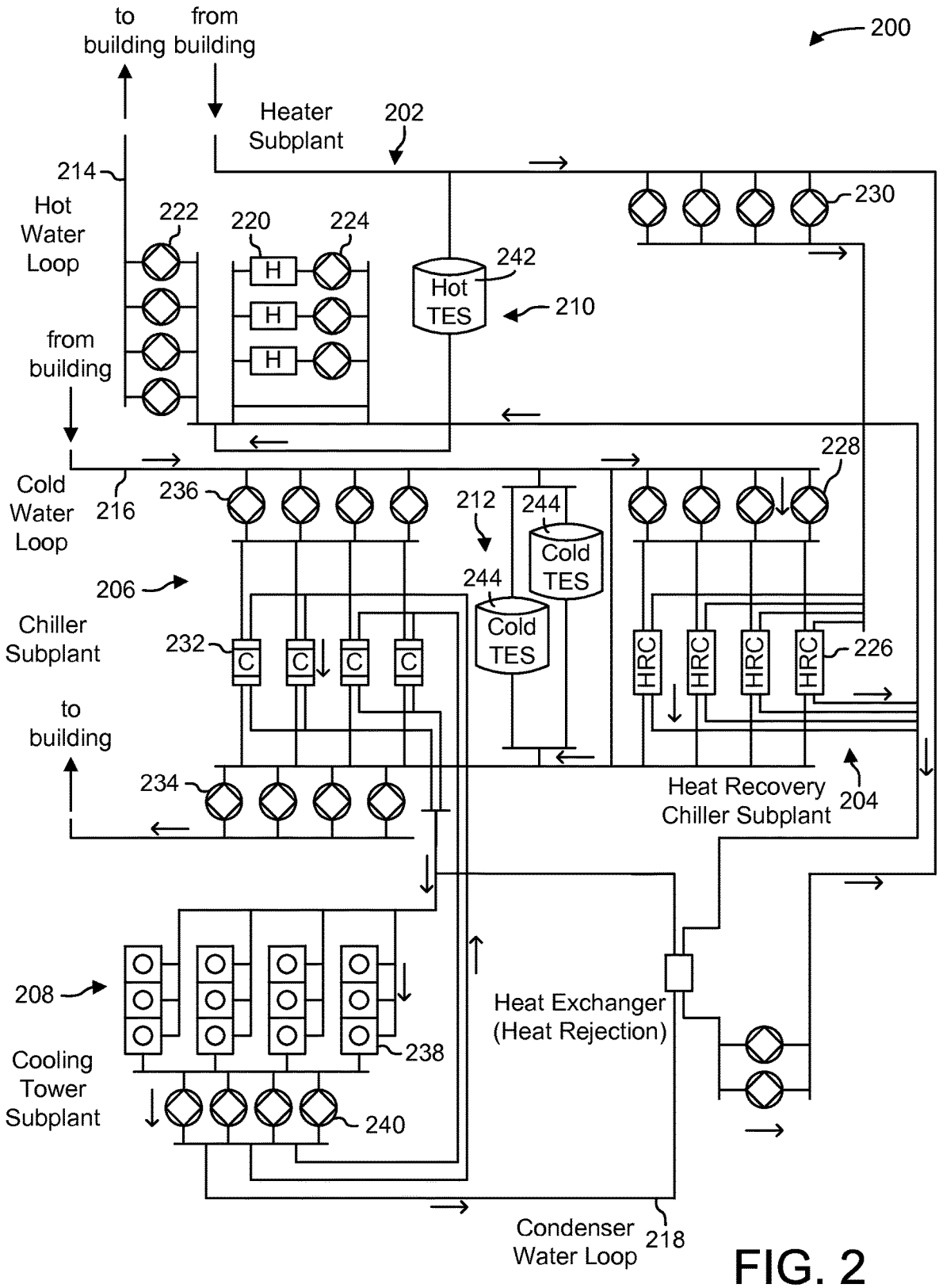
FIG. 2 is a block diagram of a waterside system that may be used in conjunction with the building of FIG. 1, according to an exemplary embodiment.

Referring now to FIG. 2, a block diagram of a waterside system 200 is shown, according to one embodiment. In various embodiments, waterside system 200 may supplement or replace waterside system 120 in HVAC system 100 or may be implemented separate from HVAC system 100. When implemented in HVAC system 100, waterside system 200 may include a subset of the HVAC devices in HVAC system 100 (e.g., boiler 104, chiller 102, pumps, valves, etc.) and may operate to supply a heated or chilled fluid to AHU 106. The HVAC devices of waterside system 200 may be located within building 10 (e.g., as components of waterside system 120) or at an offsite location such as a central plant.

In FIG. 2, waterside system 200 is shown as a central plant having a plurality of subplants 202-212. Subplants 202-212 are shown to include a heater subplant 202, a heat recovery chiller subplant 204, a chiller subplant 206, a cooling tower subplant 208, a hot thermal energy storage (TES) subplant 210, and a cold thermal energy storage (TES) subplant 212. Subplants 202-212 consume resources (e.g., water, natural gas, electricity, etc.) from utilities to serve the thermal energy loads (e.g., hot water, cold water, heating, cooling, etc.) of a building or campus. For example, heater subplant 202 may be configured to heat water in a hot water loop 214 that circulates the hot water between heater subplant 202 and building 10. Chiller subplant 206 may be configured to chill water in a cold water loop 216 that circulates the cold water between the chiller subplant 206 and the building 10. Heat recovery chiller subplant 204 may be configured to transfer heat from cold water loop 216 to hot water loop 214 to provide additional heating for the hot water and additional cooling for the cold water. Condenser water loop 218 may absorb heat from the cold water in chiller subplant 206 and reject the absorbed heat in cooling tower subplant 208 or transfer the absorbed heat to hot water loop 214. Hot TES subplant 210 and cold TES subplant 212 may store hot and cold thermal energy, respectively, for subsequent use.

Hot water loop 214 and cold water loop 216 may deliver the heated and/or chilled water to air handlers located on the rooftop of building 10 (e.g., AHU 106) or to individual floors or zones of building 10 (e.g., VAV units 116). The air handlers push air past heat exchangers (e.g., heating coils or cooling coils) through which the water flows to provide heating or cooling for the air. The heated or cooled air may be delivered to individual zones of building 10 to serve the thermal energy loads of building 10. The water then returns to subplants 202-212 to receive further heating or cooling.

Although subplants 202-212 are shown and described as heating and cooling water for circulation to a building, it is understood that any other type of working fluid (e.g., glycol, CO2, etc.) may be used in place of or in addition to water to serve the thermal energy loads. In other embodiments, subplants 202-212 may provide heating and/or cooling directly to the building or campus without requiring an intermediate heat transfer fluid. These and other variations to waterside system 200 are within the teachings of the present invention.

Each of subplants 202-212 may include a variety of equipment configured to facilitate the functions of the subplant. For example, heater subplant 202 is shown to include a plurality of heating elements 220 (e.g., boilers, electric heaters, etc.) configured to add heat to the hot water in hot water loop 214. Heater subplant 202 is also shown to include several pumps 222 and 224 configured to circulate the hot water in hot water loop 214 and to control the flow rate of the hot water through individual heating elements 220. Chiller subplant 206 is shown to include a plurality of chillers 232 configured to remove heat from the cold water in cold water loop 216. Chiller subplant 206 is also shown to include several pumps 234 and 236 configured to circulate the cold water in cold water loop 216 and to control the flow rate of the cold water through individual chillers 232.

Heat recovery chiller subplant 204 is shown to include a plurality of heat recovery heat exchangers 226 (e.g., refrigeration circuits) configured to transfer heat from cold water loop 216 to hot water loop 214. Heat recovery chiller subplant 204 is also shown to include several pumps 228 and 230 configured to circulate the hot water and/or cold water through heat recovery heat exchangers 226 and to control the flow rate of the water through individual heat recovery heat exchangers 226. Cooling tower subplant 208 is shown to include a plurality of cooling towers 238 configured to remove heat from the condenser water in condenser water loop 218. Cooling tower subplant 208 is also shown to include several pumps 240 configured to circulate the condenser water in condenser water loop 218 and to control the flow rate of the condenser water through individual cooling towers 238.

Hot TES subplant 210 is shown to include a hot TES tank 242 configured to store the hot water for later use. Hot TES subplant 210 may also include one or more pumps or valves configured to control the flow rate of the hot water into or out of hot TES tank 242. Cold TES subplant 212 is shown to include cold TES tanks 244 configured to store the cold water for later use. Cold TES subplant 212 may also include one or more pumps or valves configured to control the flow rate of the cold water into or out of cold TES tanks 244.

In some embodiments, one or more of the pumps in waterside system 200 (e.g., pumps 222, 224, 228, 230, 234, 236, and/or 240) or pipelines in waterside system 200 include an isolation valve associated therewith. Isolation valves may be integrated with the pumps or positioned upstream or downstream of the pumps to control the fluid flows in waterside system 200. In various embodiments, waterside system 200 may include more, fewer, or different types of devices and/or subplants based on the particular configuration of waterside system 200 and the types of loads served by waterside system 200.

Figure 3:
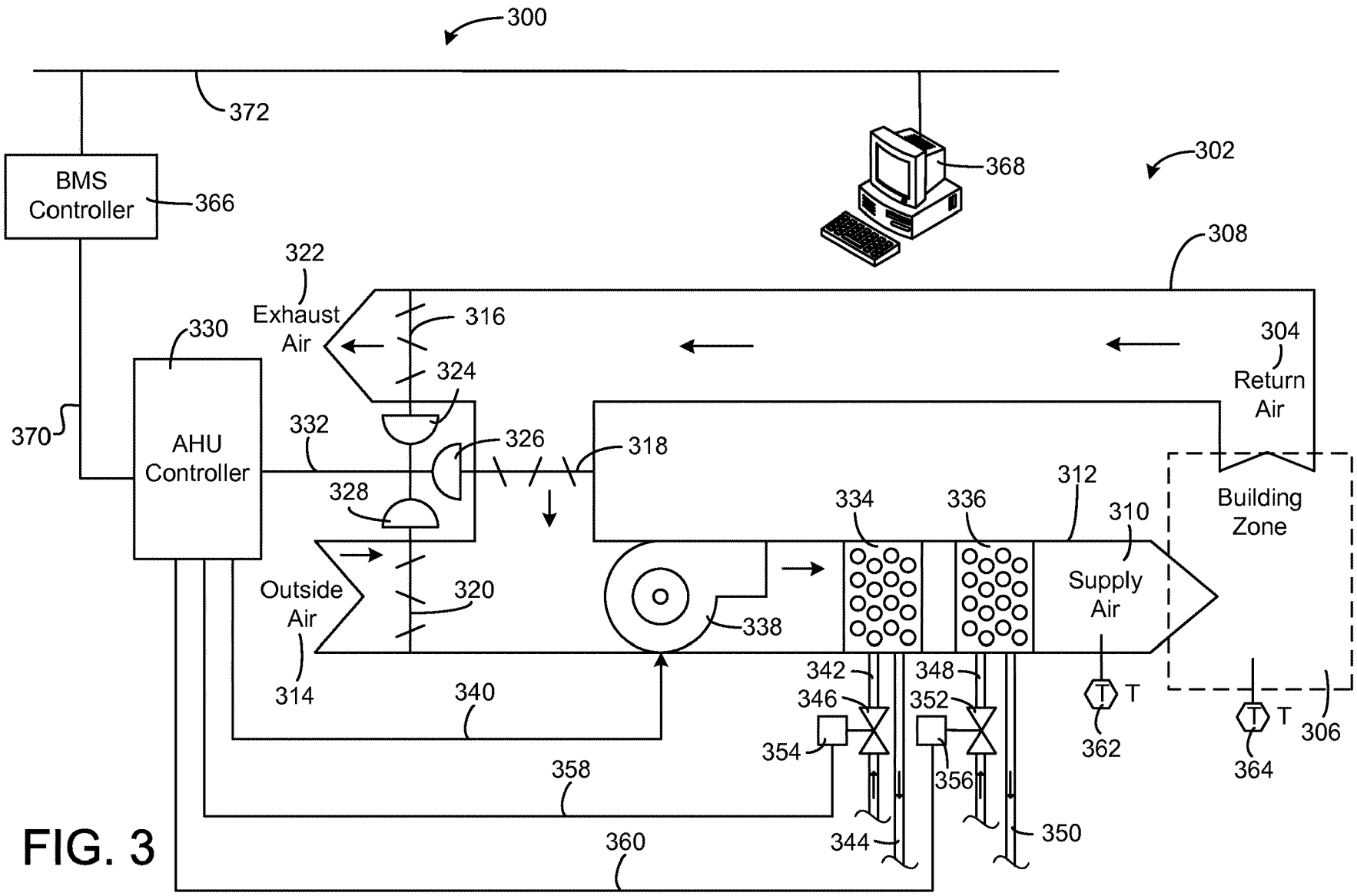
FIG. 3 is a block diagram of an airside system that may be used in conjunction with the building of FIG. 1, according to an exemplary embodiment.

Referring now to FIG. 3, a block diagram of an airside system 300 is shown, according to an exemplary embodiment. In various embodiments, airside system 300 may supplement or replace airside system 130 in HVAC system 100 or may be implemented separate from HVAC system 100. When implemented in HVAC system 100, airside system 300 may include a subset of the HVAC devices in HVAC system 100 (e.g., AHU 106, VAV units 116, ducts 112-114, fans, dampers, etc.) and may be located in or around building 10. Airside system 300 may operate to heat or cool an airflow provided to building 10 using a heated or chilled fluid provided by waterside system 200.

In FIG. 3, airside system 300 is shown to include an economizer-type air handling unit (AHU) 302. Economizer-type AHUs vary the amount of outside air and return air used by the air handling unit for heating or cooling. For example, AHU 302 may receive return air 304 from building zone 306 via return air duct 308 and may deliver supply air 310 to building zone 306 via supply air duct 312. In some embodiments, AHU 302 is a rooftop unit located on the roof of building 10 (e.g., AHU 106 as shown in FIG. 1) or otherwise positioned to receive both return air 304 and outside air 314. AHU 302 may be configured to operate exhaust air damper 316, mixing damper 318, and outside air damper 320 to control an amount of outside air 314 and return air 304 that combine to form supply air 310. Any return air 304 that does not pass through mixing damper 318 may be exhausted from AHU 302 through exhaust damper 316 as exhaust air 322.

Each of dampers 316-320 may be operated by an actuator. For example, exhaust air damper 316 may be operated by actuator 324, mixing damper 318 may be operated by actuator 326, and outside air damper 320 may be operated by actuator 328. Actuators 324-328 may communicate with an AHU controller 330 via a communications link 332. Actuators 324-328 may receive control signals from AHU controller 330 and may provide feedback signals to AHU controller 330. Feedback signals may include, for example, an indication of a current actuator or damper position, an amount of torque or force exerted by the actuator, diagnostic information (e.g., results of diagnostic tests performed by actuators 324-328), status information, commissioning information, configuration settings, calibration data, and/or other types of information or data that may be collected, stored, or used by actuators 324-328. AHU controller 330 may be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control actuators 324-328.

Still referring to FIG. 3, AHU 302 is shown to include a cooling coil 334, a heating coil 336, and a fan 338 positioned within supply air duct 312. Fan 338 may be configured to force supply air 310 through cooling coil 334 and/or heating coil 336 and provide supply air 310 to building zone 306. AHU controller 330 may communicate with fan 338 via communications link 340 to control a flow rate of supply air 310. In some embodiments, AHU controller 330 controls an amount of heating or cooling applied to supply air 310 by modulating a speed of fan 338.

Cooling coil 334 may receive a chilled fluid from waterside system 200 (e.g., from cold water loop 216) via piping 342 and may return the chilled fluid to waterside system 200 via piping 344. Valve 346 may be positioned along piping 342 or piping 344 to control a flow rate of the chilled fluid through cooling coil 334. In some embodiments, cooling coil 334 includes multiple stages of cooling coils that can be independently activated and deactivated (e.g., by AHU controller 330, by BMS controller 366, etc.) to modulate an amount of cooling applied to supply air 310.

Heating coil 336 may receive a heated fluid from waterside system 200 (e.g., from hot water loop 214) via piping 348 and may return the heated fluid to waterside system 200 via piping 350. Valve 352 may be positioned along piping 348 or piping 350 to control a flow rate of the heated fluid through heating coil 336. In some embodiments, heating coil 336 includes multiple stages of heating coils that can be independently activated and deactivated (e.g., by AHU controller 330, by BMS controller 366, etc.) to modulate an amount of heating applied to supply air 310.

Each of valves 346 and 352 may be controlled by an actuator. For example, valve 346 may be controlled by actuator 354 and valve 352 may be controlled by actuator 356. Actuators 354-356 may communicate with AHU controller 330 via communications links 358-360. Actuators 354-356 may receive control signals from AHU controller 330 and may provide feedback signals to controller 330. In some embodiments, AHU controller 330 receives a measurement of the supply air temperature from a temperature sensor 362 positioned in supply air duct 312 (e.g., downstream of cooling coil 334 and/or heating coil 336). AHU controller 330 may also receive a measurement of the temperature of building zone 306 from a temperature sensor 364 located in building zone 306.

In some embodiments, AHU controller 330 operates valves 346 and 352 via actuators 354-356 to modulate an amount of heating or cooling provided to supply air 310 (e.g., to achieve a setpoint temperature for supply air 310 or to maintain the temperature of supply air 310 within a setpoint temperature range). The positions of valves 346 and 352 affect the amount of heating or cooling provided to supply air 310 by cooling coil 334 or heating coil 336 and may correlate with the amount of energy consumed to achieve a desired supply air temperature. AHU 330 may control the temperature of supply air 310 and/or building zone 306 by activating or deactivating coils 334-336, adjusting a speed of fan 338, or a combination of both.

Still referring to FIG. 3, airside system 300 is shown to include a building management system (BMS) controller 366 and a client device 368. BMS controller 366 may include one or more computer systems (e.g., servers, supervisory controllers, subsystem controllers, etc.) that serve as system level controllers, application or data servers, head nodes, or master controllers for airside system 300, waterside system 200, HVAC system 100, and/or other controllable systems that serve building 10. BMS controller 366 may communicate with multiple downstream building systems or subsystems (e.g., HVAC system 100, a security system, a lighting system, waterside system 200, etc.) via a communications link 370 according to like or disparate protocols (e.g., LON, BACnet, etc.). In various embodiments, AHU controller 330 and BMS controller 366 may be separate (as shown in FIG. 3) or integrated. In an integrated implementation, AHU controller 330 may be a software module configured for execution by a processor of BMS controller 366.

In some embodiments, AHU controller 330 receives information from BMS controller 366 (e.g., commands, setpoints, operating boundaries, etc.) and provides information to BMS controller 366 (e.g., temperature measurements, valve or actuator positions, operating statuses, diagnostics, etc.). For example, AHU controller 330 may provide BMS controller 366 with temperature measurements from temperature sensors 362-364, equipment on/off states, equipment operating capacities, and/or any other information that can be used by BMS controller 366 to monitor or control a variable state or condition within building zone 306.

Client device 368 may include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 100, its subsystems, and/or devices. Client device 368 may be a computer workstation, a client terminal, a remote or local interface, or any other type of user interface device. Client device 368 may be a stationary terminal or a mobile device. For example, client device 368 may be a desktop computer, a computer server with a user interface, a laptop computer, a tablet, a smartphone, a PDA, or any other type of mobile or non-mobile device. Client device 368 may communicate with BMS controller 366 and/or AHU controller 330 via communications link 372.

Figure 4:
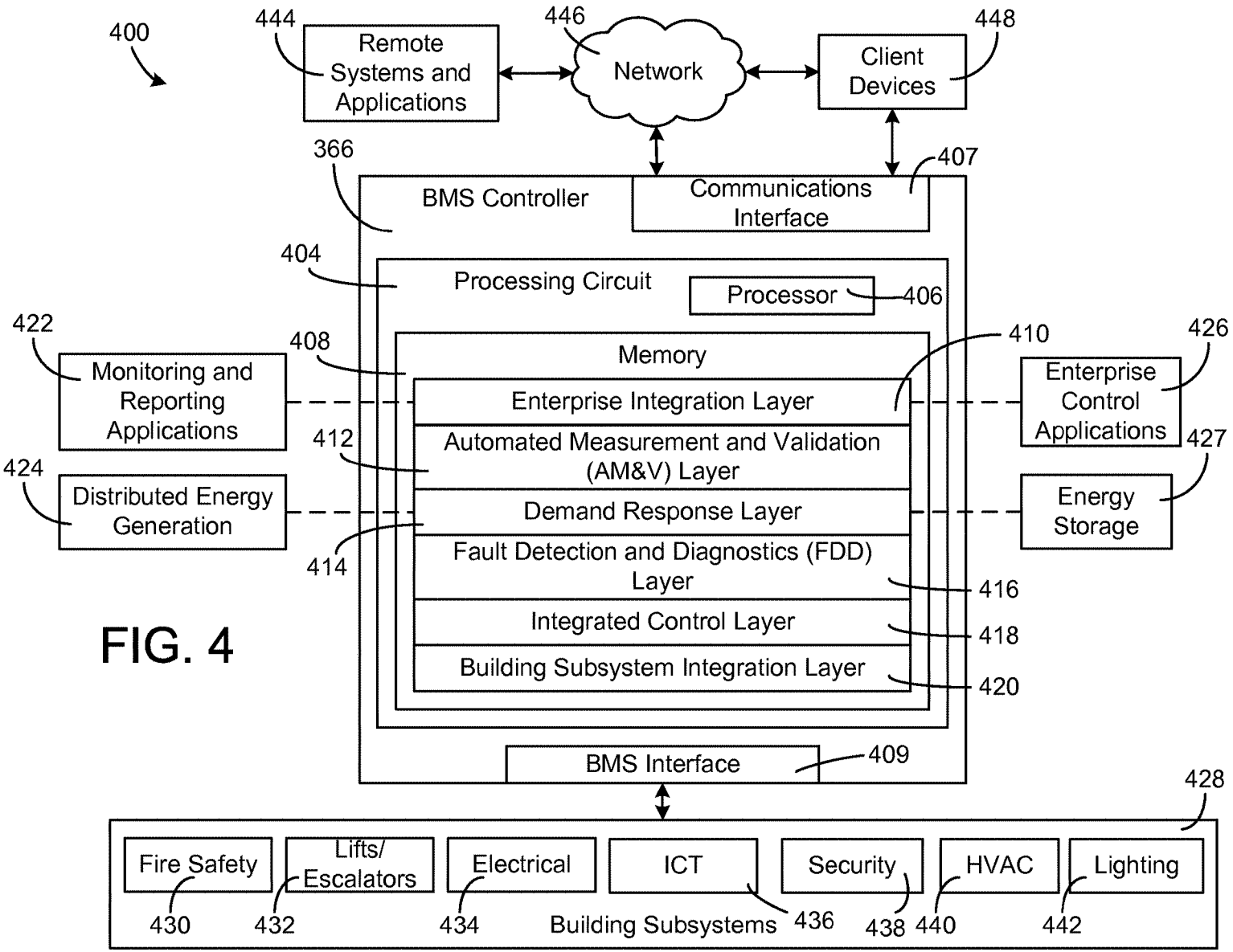
FIG. 4 is a block diagram of a building management system (BMS) that may be used to monitor and/or control the building of FIG. 1, according to an exemplary embodiment.

Referring now to FIG. 4, a block diagram of a building management system (BMS) 400 is shown, according to an exemplary embodiment. BMS 400 may be implemented in building 10 to automatically monitor and control various building functions. BMS 400 is shown to include BMS controller 366 and a plurality of building subsystems 428. Building subsystems 428 are shown to include a building electrical subsystem 434, an information communication technology (ICT) subsystem 436, a security subsystem 438, a HVAC subsystem 440, a lighting subsystem 442, a lift/escalators subsystem 432, and a fire safety subsystem 430. In various embodiments, building subsystems 428 can include fewer, additional, or alternative subsystems. For example, building subsystems 428 may also or alternatively include a refrigeration subsystem, an advertising or signage subsystem, a cooking subsystem, a vending subsystem, a printer or copy service subsystem, or any other type of building subsystem that uses controllable equipment and/or sensors to monitor or control building 10. In some embodiments, building subsystems 428 include waterside system 200 and/or airside system 300, as described with reference to FIGS. 2-3.

Each of building subsystems 428 may include any number of devices, controllers, and connections for completing its individual functions and control activities. HVAC subsystem 440 may include many of the same components as HVAC system 100, as described with reference to FIGS. 1-3. For example, HVAC subsystem 440 may include a chiller, a boiler, any number of air handling units, economizers, field controllers, supervisory controllers, actuators, temperature sensors, and other devices for controlling the temperature, humidity, airflow, or other variable conditions within building 10. Lighting subsystem 442 may include any number of light fixtures, ballasts, lighting sensors, dimmers, or other devices configured to controllably adjust the amount of light provided to a building space. Security subsystem 438 may include occupancy sensors, video surveillance cameras, digital video recorders, video processing servers, intrusion detection devices, access control devices and servers, or other security-related devices.

Still referring to FIG. 4, BMS controller 366 is shown to include a communications interface 407 and a BMS interface 409. Interface 407 may facilitate communications between BMS controller 366 and external applications (e.g., monitoring and reporting applications 422, enterprise control applications 426, remote systems and applications 444, applications residing on client devices 448, etc.) for allowing user control, monitoring, and adjustment to BMS controller 366 and/or subsystems 428. Interface 407 may also facilitate communications between BMS controller 366 and client devices 448. BMS interface 409 may facilitate communications between BMS controller 366 and building subsystems 428 (e.g., HVAC, lighting security, lifts, power distribution, business, etc.).

Interfaces 407, 409 can be or include wired or wireless communications interfaces (e.g., jacks, antennas, transmitters, receivers, transceivers, wire terminals, etc.) for conducting data communications with building subsystems 428 or other external systems or devices. In various embodiments, communications via interfaces 407, 409 may be direct (e.g., local wired or wireless communications) or via a communications network 446 (e.g., a WAN, the Internet, a cellular network, etc.). For example, interfaces 407, 409 can include an Ethernet card and port for sending and receiving data via an Ethernet-based communications link or network. In another example, interfaces 407, 409 can include a WiFi transceiver for communicating via a wireless communications network. In another example, one or both of interfaces 407, 409 may include cellular or mobile phone communications transceivers. In one embodiment, communications interface 407 is a power line communications interface and BMS interface 409 is an Ethernet interface. In other embodiments, both communications interface 407 and BMS interface 409 are Ethernet interfaces or are the same Ethernet interface.

Still referring to FIG. 4, BMS controller 366 is shown to include a processing circuit 404 including a processor 406 and memory 408. Processing circuit 404 may be communicably connected to BMS interface 409 and/or communications interface 407 such that processing circuit 404 and the various components thereof can send and receive data via interfaces 407, 409. Processor 406 can be implemented as a general purpose processor, an application specific integrated circuit (ASIC), one or more field programmable gate arrays (FPGAs), a group of processing components, or other suitable electronic processing components.

Memory 408 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Memory 408 may be or include volatile memory or non-volatile memory. Memory 408 may include database components, object code components, script components, or any other type of information structure for supporting the various activities and information structures described in the present application. According to an exemplary embodiment, memory 408 is communicably connected to processor 406 via processing circuit 404 and includes computer code for executing (e.g., by processing circuit 404 and/or processor 406) one or more processes described herein.

In some embodiments, BMS controller 366 is implemented within a single computer (e.g., one server, one housing, etc.). In various other embodiments BMS controller 366 may be distributed across multiple servers or computers (e.g., that can exist in distributed locations). Further, while FIG. 4 shows applications 422 and 426 as existing outside of BMS controller 366, in some embodiments, applications 422 and 426 may be hosted within BMS controller 366 (e.g., within memory 408).

Still referring to FIG. 4, memory 408 is shown to include an enterprise integration layer 410, an automated measurement and validation (AM&V) layer 412, a demand response (DR) layer 414, a fault detection and diagnostics (FDD) layer 416, an integrated control layer 418, and a building subsystem integration later 420. Layers 410-420 may be configured to receive inputs from building subsystems 428 and other data sources, determine optimal control actions for building subsystems 428 based on the inputs, generate control signals based on the optimal control actions, and provide the generated control signals to building subsystems 428. The following paragraphs describe some of the general functions performed by each of layers 410-420 in BMS 400.

Enterprise integration layer 410 may be configured to serve clients or local applications with information and services to support a variety of enterprise-level applications. For example, enterprise control applications 426 may be configured to provide subsystem-spanning control to a graphical user interface (GUI) or to any number of enterprise-level business applications (e.g., accounting systems, user identification systems, etc.). Enterprise control applications 426 may also or alternatively be configured to provide configuration GUIs for configuring BMS controller 366. In yet other embodiments, enterprise control applications 426 can work with layers 410-420 to optimize building performance (e.g., efficiency, energy use, comfort, or safety) based on inputs received at interface 407 and/or BMS interface 409.

Building subsystem integration layer 420 may be configured to manage communications between BMS controller 366 and building subsystems 428. For example, building subsystem integration layer 420 may receive sensor data and input signals from building subsystems 428 and provide output data and control signals to building subsystems 428. Building subsystem integration layer 420 may also be configured to manage communications between building subsystems 428. Building subsystem integration layer 420 translate communications (e.g., sensor data, input signals, output signals, etc.) across a plurality of multi-vendor/multi-protocol systems.

Demand response layer 414 may be configured to optimize resource usage (e.g., electricity use, natural gas use, water use, etc.) and/or the monetary cost of such resource usage in response to satisfy the demand of building 10. The optimization may be based on time-of-use prices, curtailment signals, energy availability, or other data received from utility providers, distributed energy generation systems 424, from energy storage 427 (e.g., hot TES 242, cold TES 244, etc.), or from other sources. Demand response layer 414 may receive inputs from other layers of BMS controller 366 (e.g., building subsystem integration layer 420, integrated control layer 418, etc.). The inputs received from other layers may include environmental or sensor inputs such as temperature, carbon dioxide levels, relative humidity levels, air quality sensor outputs, occupancy sensor outputs, room schedules, and the like. The inputs may also include inputs such as electrical use (e.g., expressed in kWh), thermal load measurements, pricing information, projected pricing, smoothed pricing, curtailment signals from utilities, and the like.

According to an exemplary embodiment, demand response layer 414 includes control logic for responding to the data and signals it receives. These responses can include communicating with the control algorithms in integrated control layer 418, changing control strategies, changing setpoints, or activating/deactivating building equipment or subsystems in a controlled manner. Demand response layer 414 may also include control logic configured to determine when to utilize stored energy. For example, demand response layer 414 may determine to begin using energy from energy storage 427 just prior to the beginning of a peak use hour.

In some embodiments, demand response layer 414 includes a control module configured to actively initiate control actions (e.g., automatically changing setpoints) which minimize energy costs based on one or more inputs representative of or based on demand (e.g., price, a curtailment signal, a demand level, etc.). In some embodiments, demand response layer 414 uses equipment models to determine an optimal set of control actions. The equipment models may include, for example, thermodynamic models describing the inputs, outputs, and/or functions performed by various sets of building equipment. Equipment models may represent collections of building equipment (e.g., subplants, chiller arrays, etc.) or individual devices (e.g., individual chillers, heaters, pumps, etc.).

Demand response layer 414 may further include or draw upon one or more demand response policy definitions (e.g., databases, XML files, etc.). The policy definitions may be edited or adjusted by a user (e.g., via a graphical user interface) so that the control actions initiated in response to demand inputs may be tailored for the user's application, desired comfort level, particular building equipment, or based on other concerns. For example, the demand response policy definitions can specify which equipment may be turned on or off in response to particular demand inputs, how long a system or piece of equipment should be turned off, what setpoints can be changed, what the allowable set point adjustment range is, how long to hold a high demand setpoint before returning to a normally scheduled setpoint, how close to approach capacity limits, which equipment modes to utilize, the energy transfer rates (e.g., the maximum rate, an alarm rate, other rate boundary information, etc.) into and out of energy storage devices (e.g., thermal storage tanks, battery banks, etc.), and when to dispatch on-site generation of energy (e.g., via fuel cells, a motor generator set, etc.).

Integrated control layer 418 may be configured to use the data input or output of building subsystem integration layer 420 and/or demand response later 414 to make control decisions. Due to the subsystem integration provided by building subsystem integration layer 420, integrated control layer 418 can integrate control activities of the subsystems 428 such that the subsystems 428 behave as a single integrated supersystem. In an exemplary embodiment, integrated control layer 418 includes control logic that uses inputs and outputs from a plurality of building subsystems to provide greater comfort and energy savings relative to the comfort and energy savings that separate subsystems could provide alone. For example, integrated control layer 418 may be configured to use an input from a first subsystem to make an energy-saving control decision for a second subsystem. Results of these decisions can be communicated back to building subsystem integration layer 420.

Integrated control layer 418 is shown to be logically below demand response layer 414. Integrated control layer 418 may be configured to enhance the effectiveness of demand response layer 414 by enabling building subsystems 428 and their respective control loops to be controlled in coordination with demand response layer 414. This configuration may advantageously reduce disruptive demand response behavior relative to conventional systems. For example, integrated control layer 418 may be configured to assure that a demand response-driven upward adjustment to the setpoint for chilled water temperature (or another component that directly or indirectly affects temperature) does not result in an increase in fan energy (or other energy used to cool a space) that would result in greater total building energy use than was saved at the chiller.

Integrated control layer 418 may be configured to provide feedback to demand response layer 414 so that demand response layer 414 checks that constraints (e.g., temperature, lighting levels, etc.) are properly maintained even while demanded load shedding is in progress. The constraints may also include setpoint or sensed boundaries relating to safety, equipment operating limits and performance, comfort, fire codes, electrical codes, energy codes, and the like. Integrated control layer 418 is also logically below fault detection and diagnostics layer 416 and automated measurement and validation layer 412. Integrated control layer 418 may be configured to provide calculated inputs (e.g., aggregations) to these higher levels based on outputs from more than one building subsystem.

Automated measurement and validation (AM&V) layer 412 may be configured to verify that control strategies commanded by integrated control layer 418 or demand response layer 414 are working properly (e.g., using data aggregated by AM&V layer 412, integrated control layer 418, building subsystem integration layer 420, FDD layer 416, or otherwise). The calculations made by AM&V layer 412 may be based on building system energy models and/or equipment models for individual BMS devices or subsystems. For example, AM&V layer 412 may compare a model-predicted output with an actual output from building subsystems 428 to determine an accuracy of the model.

Fault detection and diagnostics (FDD) layer 416 may be configured to provide on-going fault detection for building subsystems 428, building subsystem devices (i.e., building equipment), and control algorithms used by demand response layer 414 and integrated control layer 418. FDD layer 416 may receive data inputs from integrated control layer 418, directly from one or more building subsystems or devices, or from another data source. FDD layer 416 may automatically diagnose and respond to detected faults. The responses to detected or diagnosed faults may include providing an alert message to a user, a maintenance scheduling system, or a control algorithm configured to attempt to repair the fault or to work-around the fault.

FDD layer 416 may be configured to output a specific identification of the faulty component or cause of the fault (e.g., loose damper linkage) using detailed subsystem inputs available at building subsystem integration layer 420. In other exemplary embodiments, FDD layer 416 is configured to provide "fault" events to integrated control layer 418 which executes control strategies and policies in response to the received fault events. According to an exemplary embodiment, FDD layer 416 (or a policy executed by an integrated control engine or business rules engine) may shut-down systems or direct control activities around faulty devices or systems to reduce energy waste, extend equipment life, or assure proper control response.

FDD layer 416 may be configured to store or access a variety of different system data stores (or data points for live data). FDD layer 416 may use some content of the data stores to identify faults at the equipment level (e.g., specific chiller, specific AHU, specific terminal unit, etc.) and other content to identify faults at component or subsystem levels. For example, building subsystems 428 may generate temporal (i.e., time-series) data indicating the performance of BMS 400 and the various components thereof. The data generated by building subsystems 428 may include measured or calculated values that exhibit statistical characteristics and provide information about how the corresponding system or process (e.g., a temperature control process, a flow control process, etc.) is performing in terms of error from its setpoint. These processes can be examined by FDD layer 416 to expose when the system begins to degrade in performance and alert a user to repair the fault before it becomes more severe.

Locating Building Equipment

Figure 5:
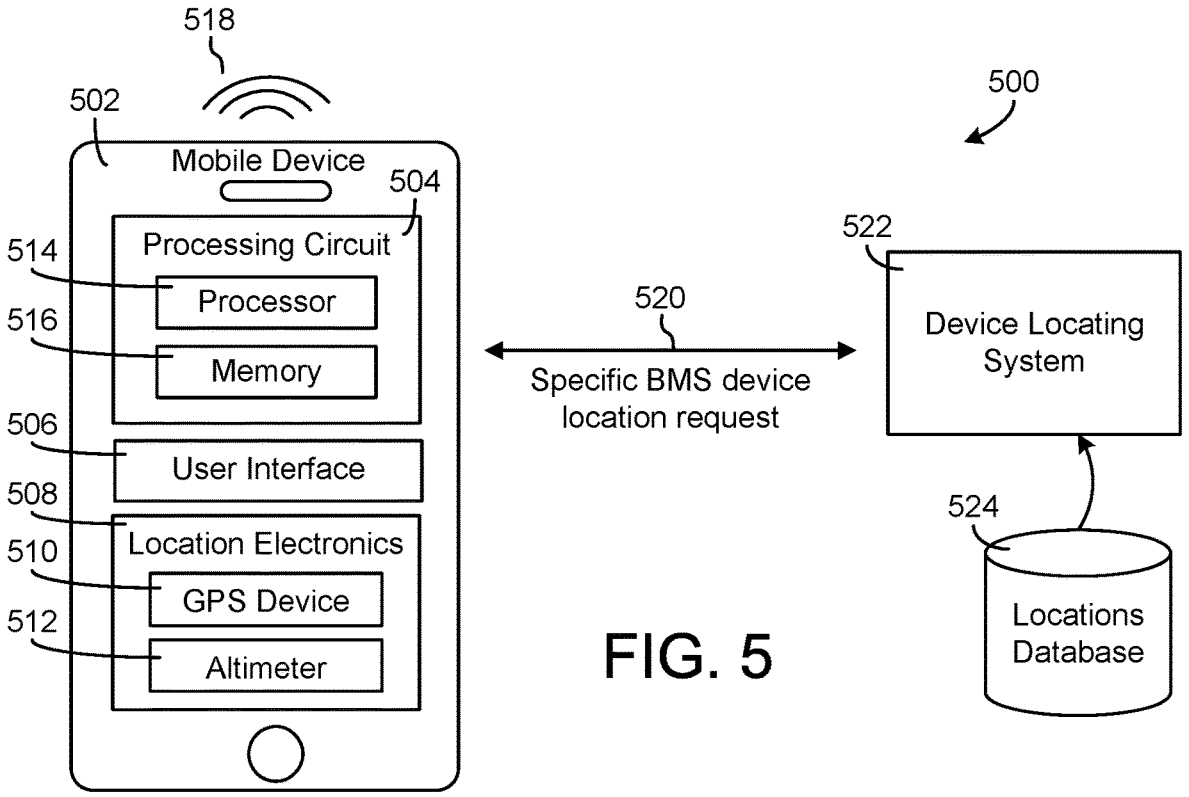
FIGS. 5-6 are drawings of a system for retrieving and displaying the locations of building equipment, according to an exemplary embodiment.
Figure 6:
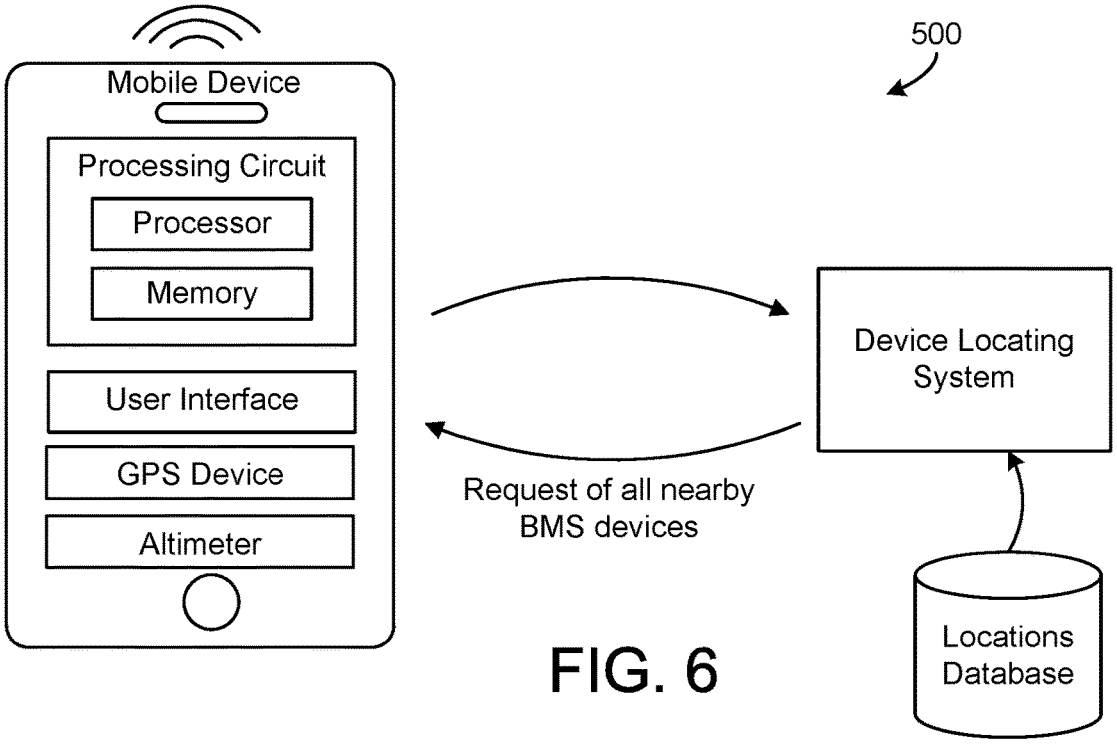

Referring now to FIGS. 5-6, a system 500 for locating building equipment is shown, according to an exemplary embodiment. Locating building equipment is often the first step required to service, inspect, or repair the building equipment. For example, a service technician may arrive at a customer site for the purpose of repairing a faulty article of building equipment. Before the equipment can be serviced, the technician must locate the building equipment. Locating building equipment can be difficult when the service technician is unfamiliar with the building and/or if the building equipment is hidden or obstructed (e.g., behind a wall, above a ceiling tile, etc.).

System 500 may be used to identify the locations of BMS devices (i.e., building equipment) in a building. Throughout this disclosure, the terms "BMS device" and "building equipment" are used interchangeably. BMS devices may include any equipment that can be implemented in or around a building. For example, BMS devices may include chillers, heaters, pumps, actuators, valves, dampers, fans, switches, air handling units, power supplies, controllers, communications electronics, or any other device or collection of devices that can be used to monitor, control, or otherwise affect the environment in or around a building. BMS devices may include any of the systems or devices within building 10, HVAC system 100, waterside system 200, airside system 300, and/or BMS 400 as described with reference to FIGS. 1-4.

System 500 is shown to include a mobile device 502. The mobile device 502 may be a smartphone, a tablet, a PDA, a laptop computer, or any other type of portable computing device. Further, the mobile device 502 may be a dedicated hardware device for use with the system 500. The mobile device is shown to include a processing circuit 504, a user interface 506, and location electronics 508. In one embodiment, the location electronics 508 include a GPS device 510, and an altimeter 512. In some embodiments, the mobile device 502 includes a camera, an accelerometer, and/or any other component typically included in a smartphone, tablet, or the like.

The processing circuit 504 is shown to include a processor 514 and memory 516. The processor 514 may be a general purpose or specific purpose processor, an application specific integrated circuit (ASIC), one or more field programmable gate arrays (FPGAs), a group of processing components, or other suitable processing components. The processor 514 is configured to execute computer code or instructions stored in memory or received from other computer readable media (e.g., CDROM, network storage, a remote server, etc.).

The memory 516 may include one or more devices (e.g., memory units, memory devices, storage devices, etc.) for storing data and/or computer code for completing and/or facilitating the various processes described in the present disclosure. The memory 516 may include random access memory (RAM), read-only memory (ROM), hard drive storage, temporary storage, non-volatile memory, flash memory, optical memory, or any other suitable memory for storing software objects and/or computer instructions. The memory 516 may include database components, object code components, script components, or any other type of information structure for supporting the various activities and information structures described in the present disclosure. The memory 516 may be communicably connected to the processor 514 via the processing circuit 504 and may include computer code for executing (e.g., by the processor) one or more processes described herein. When the processor 514 executes instructions stored in the memory 516, the processor 514 generally configures the mobile device (and more particularly the processing circuit 504) to complete such activities.

The user interface 506 may be configured to present information to a user and/or receive input from a user. For example, the user interface 506 may include a touch-sensitive display, one or more physical buttons, switches, dials, a speaker, a microphone, or any other type of user input or output device. In some embodiments, the user interface 506 presents a graphical user interface (GUI) that allows a user to search for particular BMS devices. For example, the user interface 506 may present a GUI that facilitates searching for BMS devices by device name (e.g., device ID), device type, device location, fault status, operating state, or any other variable or fixed parameter describing the BMS devices. In some embodiments, the GUI facilitates identifying one or more nearby BMS devices based on the locations of the BMS devices relative to the mobile device 502. The user interface 506 may also be used to monitor and control BMS devices. In some embodiments, the mobile device 502 runs an application configured to generate the GUIs. In other embodiments, the GUIs are generated by another system or device and provided to the mobile device 502 via a communications link 518. Several exemplary GUIs that can be presented via the user interface 506 are described in greater detail with reference to FIGS. 14-22.

In one embodiment, the mobile device 502 is configured to measure its own location (e.g., GPS coordinates, altitude, etc.) using the location electronics 508. In some embodiments, the mobile device 502 include a wireless communications interface 520 (e.g., a WiFi transceiver, a NFC transceiver, a Bluetooth transceiver, a cellular transceiver, etc.) configured to conduct wireless data communications with other systems or devices. The mobile device 502 may use the communications interface 520 to send a request for a BMS device location to a device locating system 522. The request may be generated automatically by the application running on the mobile device 502. In some embodiments, the request is generated in response to a user selecting a particular BMS device or set of BMS devices via the user interface 506. In various embodiments, the request may specify a particular BMS device (e.g., by device ID, device name, etc.), or may request a list of nearby devices (e.g., all nearby devices, nearby devices meeting user-specified criteria, etc.) as shown in FIG. 6. For example, the mobile device 502 may provide the device locating system 522 with the location of the mobile device 502 (determined using the location electronics 508) and request a list of all chillers within a predetermined distance of the mobile device 502.

The device locating system 522 may receive and process requests for BMS device locations. In some embodiments, the device locating system 522 retrieves the BMS device locations from a locations database 524. The locations database 524 may store a location (e.g., GPS coordinates, altitude, three-dimensional coordinates, etc.) for various BMS devices. The device locations in the locations database 524 may be specified by a user when the BMS devices are initially installed, reported by the BMS devices after commissioning, automatically measured, received from an external system or device, or otherwise stored in the locations database 524. Several example methods for detecting and storing BMS device locations are described in greater detail with reference to FIGS. 7-10. The device locating system 522 may report the BMS device locations to the mobile device 502 in response to the request. The device locations may include the location of a particular BMS device (as shown in FIG. 5) and/or a list of one or more nearby BMS devices/locations (as shown in FIG. 6).

The mobile device 502, via an application running on the mobile device 502 may present the requested BMS device location(s) via the user interface 506. For example, the mobile device 502 may display a street map, floor plan, or other type of display that indicates the location of the BMS device via the user interface 506. In some embodiments, the mobile device 502 uses the requested BMS device location in conjunction with the mobile device's 502 own location to display the location of the BMS device relative to the mobile device 502 via the user interface 506. For example, the mobile device 502 may generate a map or floorplan on the user interface 506 that includes the location of the BMS device and the location of the mobile device 502. The map or floorplan may include an arrow, a direction, or other indication of the BMS device location relative to the mobile device 502.

In some embodiments, the mobile device 502 generates an augmented reality display to present the BMS device location. For example, the mobile device 502 may use an integrated camera to generate a view of the room or space in which the mobile device 502 is located. The images from the camera may be presented via the user interface 506. The mobile device 502 may overlay the location of the BMS device onto the image of the room or space. The augmented reality display advantageously allows the user (e.g., a service technician) to readily determine the location of the BMS device, even if the BMS device is hidden behind a wall, ceiling tile, or otherwise obstructed from view. In some embodiments, the augmented reality display includes one or more selectable icons that cause the BMS device to emit a light, sound, or otherwise announce its location via visual or auditory stimuli.

Figure 7:
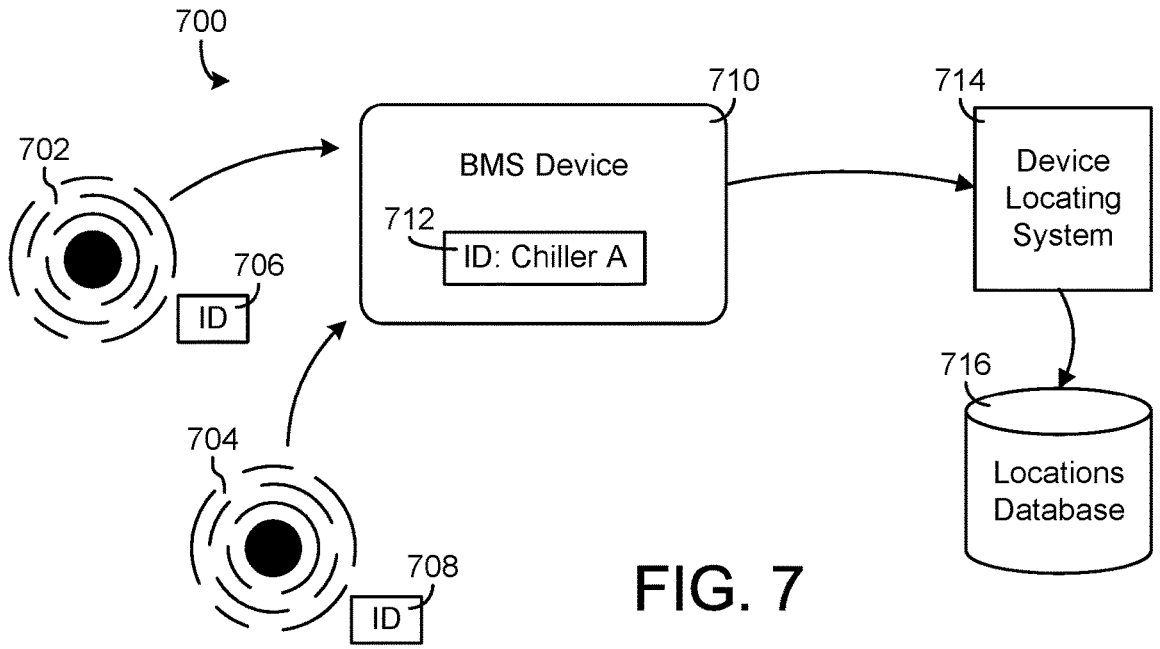
FIGS. 7-10 are drawings of systems for determining and storing the locations of building equipment, according to an exemplary embodiment.

Referring now to FIGS. 7-10, several systems 700-1000 for determining BMS device locations are shown, according to an exemplary embodiment. Systems 700-1000 may be used to automatically populate a locations database with the locations of various BMS devices. Referring particularly to FIG. 7, system 700 is shown to include a plurality of wireless emitters/receivers 702, 704. Each of the wireless emitters/receivers 702, 704 may be located at a different position in a building (e.g., inside rooms or zones, at entrance/exit points, in hallways, etc.) and may be associated with a different emitter identifier 706, 708 for identifying each of the plurality of wireless emitters/receivers 702, 704. The emitter identifiers 706, 708 may include information related to the location of each wireless emitter/receiver 702, 704. The emitter identifiers 706, 708 may also include other identifying information such as emitter/receiver type, emitter/receiver ID, frequency information, etc. In one embodiment, the locations of the wireless emitters/receivers 702, 704 are known to the device locating system.

The wireless emitters/receivers 702, 704 may be configured to emit, receive, sense, relay, or otherwise engage in unidirectional or bidirectional wireless communications. The wireless emitters/receivers 702, 704 may use any type of wireless technology or communications protocol. For example, in various embodiments, the wireless emitters/receivers 702, 704 may be Bluetooth low energy (BLE) emitters, near field communications (NFC) devices, WiFi transceivers, RFID devices, ultrawide band (UWB) devices, infrared emitters/sensors, visible light communications (VLC) devices, ultrasound devices, cellular transceivers, iBeacons, or any other type of hardware configured to facilitate wireless data communications. In some embodiments, the wireless emitters/receivers 702, 704 may be integrated with BMS devices within the building (e.g., thermostats, lighting sensors, zone controllers).

As shown in FIG. 7, each of the wireless emitters/receivers 702, 704 may broadcast a wireless signal. The wireless signal broadcast by an emitter/receiver 702, 704 may include an indication of the emitter identifier 706, 708 associated with the wireless emitter/receiver 702, 704. In some embodiments, the wireless signal broadcast by emitter/receivers 702, 704 includes multiple emitter identifiers 706, 708 (e.g., a UUID value, a major value, a minor value, etc.). A BMS device 710 may detect the wireless signals emitted by the wireless emitter/receivers 702, 704. The BMS device 710 may be configured to identify the emitter identifier 706, 708 associated with the wireless signal. In some embodiments, the BMS device 710 detects the signal strength of the wireless signals emitted by the wireless emitter/receivers 702, 704.

The BMS device 710 is associated with device identifier 712 (e.g., "Chiller A") that can be used to distinguish the BMS device 710 from other BMS devices. In some embodiments, the BMS device 710 reports the emitter identifiers 702, 704, the device identifier 712, and/or the signal strengths associated with the detected wireless signals to a device locating system 714. The device locating system 714 may use the emitter identifiers 706, 708 to determine a three-dimensional location of the BMS device 710 (e.g., in a particular room or building zone, nearby a particular wireless emitter receiver 702, 704, etc.). For example, the device locating system 714 may use the known locations of the wireless emitters/receivers 702, 704 to determine a location that is likely to be within range of all the wireless emitters/receivers 702, 704 detected by the BMS device 710. In other embodiments, the BMS device 710 determines its own three-dimensional location based on the detected emitter identifier(s) 706, 708 and reports the three-dimensional location to the device locating system 714. The device locating system 714 may be configured to associate the three-dimensional location with the device identifier 706, 708 and to store the association in a locations database 716.

Figure 8:
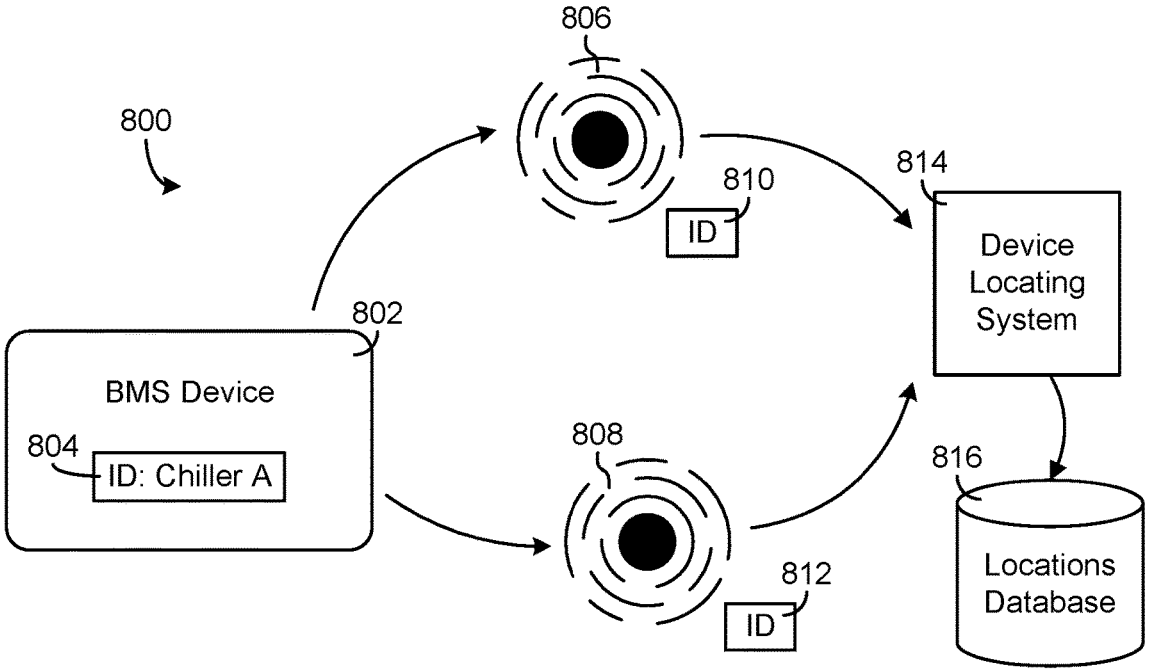

Referring now to FIG. 8, another system 800 for determining equipment locations is shown, according to an exemplary embodiment. In system 800, a BMS device 802 broadcasts its device ID 804. In one embodiment, the BMS device 802 broadcasts its device ID 804 using an integrated wireless transmitter. A number of wireless emitters/receivers 806, 808 may detect the broadcasted device ID 804 and/or the signal strength associated therewith. The wireless emitters/receivers 806, 808 may report their own emitter IDs 810, 812, the detected BMS device IDs 804, and/or the signal strengths to a device locating system 814. The device locating system 814 uses this information to determine a three-dimensional location of the BMS device 802. For example, the device locating system 814 may use the known locations of the wireless emitters/receivers 806, 808 to determine a location that is likely to be within range of all the wireless emitters/receivers 806, 808 that detect the same BMS device 802. The device locating system 814 may be configured to associate the three-dimensional location with the device identifier 804 and to store the association in a locations database 816.

Figure 9:
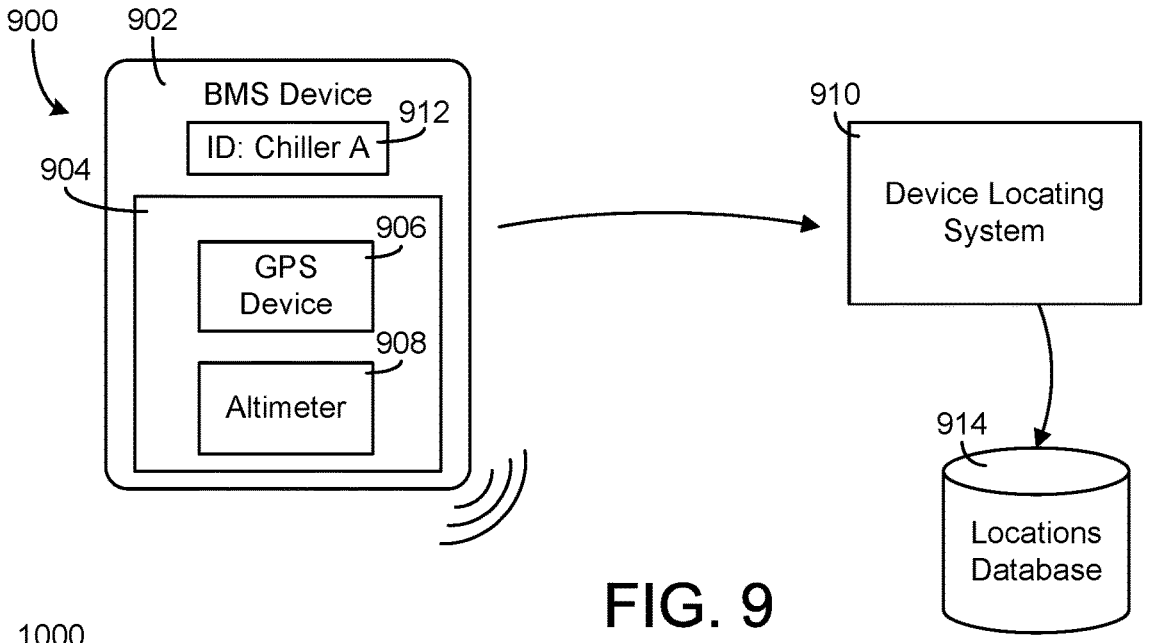

Referring now to FIG. 9, another system 900 for determining equipment locations is shown, according to one embodiment. In system 900, a BMS device 902 includes integrated location-sensing electronics 904. In one embodiment, the integrated location-sensing electronics 904 include a GPS device 906 and an altimeter 908. The BMS device 902 may measure its own location using the location electronics 904 and report the location to a device locating system 910. The BMS device 902 may also report its device identifier 912. In some embodiments, the BMS device 902 reports the location information (e.g., GPS data and altitude data) and the device identifier 912 to the device locating system 910. The device locating system 910 may use the location information from the location electronics 904 and the device identifier 912 to determine a three-dimensional location of the BMS device 902. In other embodiments, the BMS device 902 determines its own three-dimensional (i.e., global) position based on data received from the GPS device 906 and the altimeter 908, and reports a three-dimensional location to the device locating system 910. The device locating system 910 may be configured to associate the location with the device identifier 912 and to store the association in a locations database 914.

Figure 10:
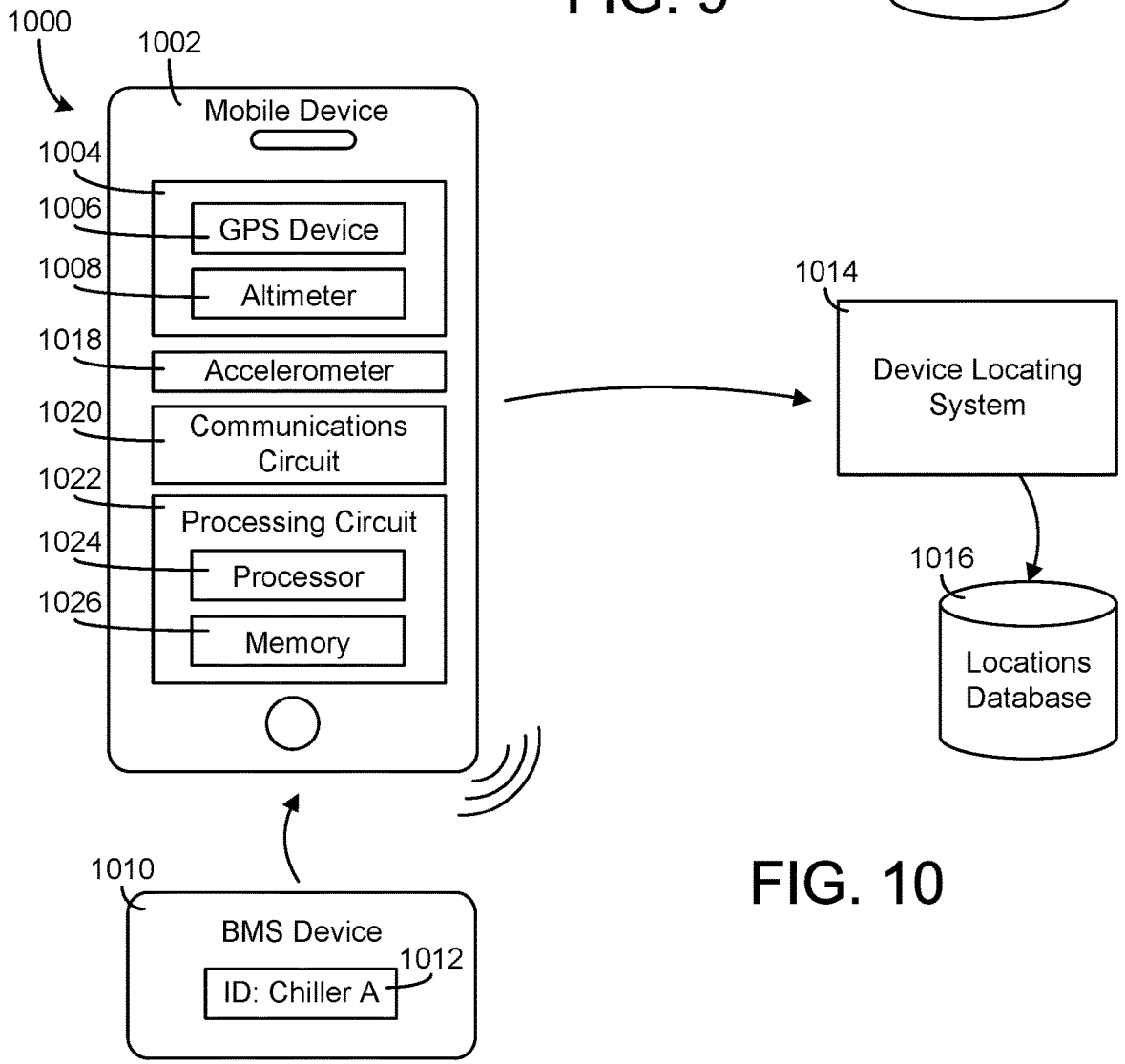

Referring now to FIG. 10, another system 1000 for determining equipment locations is shown, according to one embodiment. In system 1000, a mobile device 1002 includes location-sensing electronics 1004. The location-sensing electronics 1004 may include a GPS device 1006 and an altimeter 1008. When the mobile device 1002 is brought within range of a BMS device 1010, the mobile device detects a device ID 1012 broadcast by the BMS device 1010. The mobile device 1010 may measure its own location using the location electronics 1004 and the signal strength of the broadcast device ID 1012 at various locations within or around a building. The mobile device 1002 may report such measurements to a device locating system 1014. The device locating system 1014 may use the measured locations of the mobile device 1002 in conjunction with the corresponding signal strength of the broadcast device ID 1012 with respect to a particular BMS device 1010 to determine or estimate a location of the BMS device 1010. The location of the BMS device 1010 can then be stored in a locations database 1016, thereby allowing for dynamic location determination of BMS devices, such as BMS device 1010.

In some embodiments, the mobile device 1002 is configured to record a GPS location at an entrance of the building. The mobile device 1002 may include an accelerometer 1018 configured to collect data from which a change in position can be determined. The mobile device 1002 or the device locating system 1014 may combine the GPS location of the building entrance with the change in position of the mobile device 1002 from the building entrance to the location of the BMS device 1010 to determine a three-dimensional location of the BMS device 1010 within the building.

In some embodiments, the mobile device 1002 receives the device identifier 1012 for the BMS device 1010 via communication circuit 1020. The communication circuit 1020 may be configured to communicate with Bluetooth low energy (BLE) emitters, near field communications (NFC) devices, WiFi transceivers, RFID devices, ultrawide band (UWB) devices, infrared emitters/sensors, visible light communications (VLC) devices, ultrasound devices, cellular transceivers, iBeacons, or any other type of hardware configured to facilitate wireless data communications. The device identifier 1012 may be received automatically from the BMS device 1010 (e.g., via the communications circuit 1020) or received as a user input directly to the mobile device 1002. For example, a technician can input the device identifier 1012 manually via a user interface 1020 or by scanning the BMS device 1010 using onboard hardware of the mobile device (e.g., a RFID scanner, an optical scanner, etc.).

In some embodiments, the mobile device 1002 reports the location information (e.g., GPS data and altitude data) and the device identifier 1012 to the device locating system 1014. The device locating system 1014 may use the location information and the device identifier 1012 to determine a three-dimensional location of the BMS device 1010. In other embodiments, the mobile device 1002 determines its own three-dimensional (i.e., global) position based on the GPS data and altitude data and reports the three-dimensional location to the device locating system 1014. The mobile device 1002 may use processing circuit 1022 to process the data received from the GPS device 1006 and the altimeter 1008, along with data from the accelerometer 1018. In one embodiment, the processing circuit 1022 includes a processor 1024 and a memory 1026. The device locating system 1014 may be configured to associate the location with the device identifier 1012 and to store the association in the locations database 1016 to dynamically construct the locations database 1016.

Figure 11:
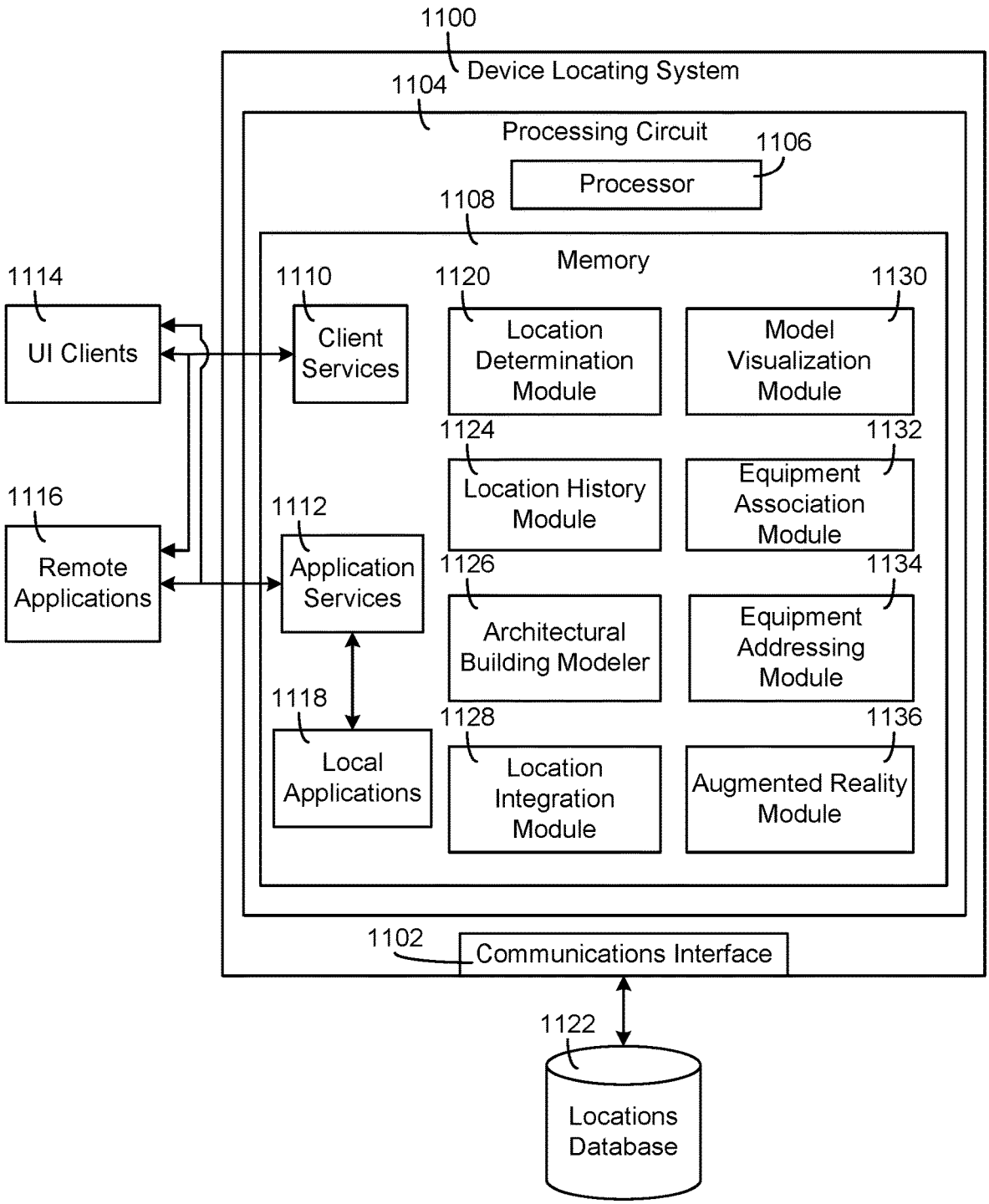
FIG. 11 is a block diagram of a device locating system configured to determine the locations of building equipment, according to an exemplary embodiment.

Referring now to FIG. 11, a block diagram illustrating a device locating system 1100 in greater detail is shown, according to one embodiment. The device locating system 1100 is shown to include a communications interface 1102 and a processing circuit 1104. The communications interface 1102 may include wired or wireless interfaces (e.g., jacks, antennas, transmitters, receivers, transceivers, wire terminals, etc.) for conducting data communications with various systems, devices, or networks. For example, the communications interface 1102 can include an Ethernet card and port for sending and receiving data via an Ethernet-based communications network. As another example, the communications interface 1102 may include a WiFi transceiver for communicating via a wireless communications network. The communications interface 1102 may be configured to communicate via local area networks (e.g., a building LAN), wide area networks (e.g., the Internet, a cellular network, etc.), and/or conduct direct communications (e.g., NFC, Bluetooth, etc.). In various embodiments, the communications interface 1102 may be configured to conduct wired and/or wireless communications. In some embodiments, the communications interface 1102 includes an application gateway configured to receive input from applications running on client devices. For example, the communications interface 1102 may include one or more wireless transceivers (e.g., a WiFi transceiver, a Bluetooth transceiver, a NFC transceiver, a cellular transceiver, etc.) for communicating with mobile devices.

The processing circuit 1104 is shown to include a processor 1106 and memory 1108. The processor 1106 may be a general purpose or specific purpose processor, an application specific integrated circuit (ASIC), one or more field programmable gate arrays (FPGAs), a group of processing components, or other suitable processing components. The processor 1106 is configured to execute computer code or instructions stored in memory 1108 or received from other computer readable media (e.g., CDROM, network storage, a remote server, etc.).

The memory 1108 may include one or more devices (e.g., memory units, memory devices, storage devices, etc.) for storing data and/or computer code for completing and/or facilitating the various processes described in the present disclosure. The memory 1108 may include random access memory (RAM), read-only memory (ROM), hard drive storage, temporary storage, non-volatile memory, flash memory, optical memory, or any other suitable memory for storing software objects and/or computer instructions. The memory 1108 may include database components, object code components, script components, or any other type of information structure for supporting the various activities and information structures described in the present disclosure. The memory 1108 may be communicably connected to the processor 1106 via the processing circuit 1104 and may include computer code for executing (e.g., by the processor) one or more processes described herein. When the processor 1106 executes instructions stored in memory 1108, the processor 1106 generally configures the device locating system 1100 (and more particularly the processing circuit 1104) to complete such activities.

Still referring to FIG. 11, the device locating system 1100 is shown to include client services 1110 and application services 1112. Client services 1110 may be configured to facilitate interaction and/or communication between the device locating system 1100 and various internal or external clients or applications. For example, client services 1110 may include web services or application programming interfaces available for communication by UI clients 1114 and remote applications 1116. UI clients 1114 can include BMS devices, BMS controllers, mobile devices, or other devices coupled to the device locating system 1100. Remote applications 1116 can include applications running on a mobile device, energy monitoring applications, applications allowing a user to monitor the performance of the BMS, automated fault detection and diagnostics systems, etc. Application services 1112 may facilitate direct or indirect communications between remote applications 1116, local applications 1118, and the device locating system 1100. For example, application services 1112 may allow the device locating system 1100 to communicate (e.g., over a communications network) with remote applications 1116 running on mobile devices and/or with a BMS controller.

In some embodiments, application services 1112 facilitate an applications gateway for conducting electronic data communications with UI clients 1114 and/or remote applications 1116. For example, application services 1112 may be configured to receive communications from mobile devices and/or BMS devices. Communications may include detected emitter identifiers, GPS data, altimeter data, accelerometer data, and/or other data from mobile devices and/or BMS devices. Client services 1110 may provide UI clients 1114 with a graphical visualization (e.g., a three-dimensional model, an augmented reality overlay, etc.) of the building with the locations of various BMS devices represented in the graphical visualization (described in greater detail below).

Still referring to FIG. 11, the device locating system 1100 is shown to include a location determination module 1120. The location determination module 1120 may be configured to determine the location of building equipment in or around the building. In some embodiments, the location determination module 1120 determines the location of building equipment based on information received from the building equipment. For example, the location determination module 1120 may receive one or more emitter identifiers reported by the building equipment, as described with reference to FIGS. 7 and 9.

The location determination module 1120 may receive a single emitter identifier from the building equipment or multiple emitter identifiers from the building equipment. For example, a BMS device may report the emitter identifier associated with each wireless signal (e.g., from one of the wireless emitters/receivers) that is detected by the BMS device to the location determination module 1120. If the BMS device is within range of multiple wireless emitters/receivers, the BMS device may report multiple emitter identifiers. For embodiments in which the BMS device reports multiple emitter identifiers, each emitter identifier may be reported in conjunction with a signal strength. The signal strength associated with an emitter identifier may indicate a relative proximity of the BMS device to the corresponding wireless emitter (e.g., high signal strengths indicating a closer proximity and low signal strengths indicating a more distant proximity).

In a further example, the location determination module 1120 may determine the location of a BMS device based on the emitter identifier or emitter identifiers received from the BMS device. In some embodiments, the location determination module 1120 uses the emitter identifier(s) received from a BMS device to determine which of the plurality of the wireless emitters/receivers is closest to the BMS device (e.g., based on signal strength, triangulation, etc.). For example, the location determination module 1120 may use an emitter identifier received from a BMS device as an input to a relational database (e.g., a lookup table, a device mapping, etc.). Each emitter identifier may uniquely indicate a particular wireless emitter (e.g., by emitter device name, by serial number, etc.) and/or a particular location (e.g., a zone name, a zone identifier, etc.) in the relational database.

In some embodiments, the location determination module 1120 receives GPS data and/or altimeter data from the a BMS device. For example, various BMS devices may be equipped with GPS receivers and/or altimeters. The BMS devices may report location information (e.g., GPS data and altitude data) and a device identifier to the location determination module 1120. The location determination module 1120 may use the location information and the device identifier to determine a three-dimensional location of the BMS device. The location determination module 1120 may be configured to associate the three-dimensional location with the device identifier and to store the association in a locations database 1122.

In some embodiments, the location determination module 1120 receives GPS data and/or altimeter data from a mobile device, such as the mobile devices described above with respect to FIGS. 5, 6 and 10. The mobile device may be transported to the physical location of one or more pieces of building equipment within the building. The mobile device may obtain location information (e.g., GPS data and altitude data) and report the location information to the location determination module 1120. In various embodiments, the mobile device records a GPS location and/or an altitude at the location of the building equipment or at an entrance of the building (e.g., for embodiments in which the GPS signal is too weak to determine obtain a GPS measurement within the building). In some embodiments the mobile device includes an accelerometer configured to collect data from which a change in position can be determined. The mobile device may report the accelerometer data to the location determination module 1120. The location determination module 1120 may combine the location information at the building entrance with the change in position between the building entrance and the location of the building equipment to determine the three-dimensional location of the building equipment within the building.

Still referring to FIG. 11, the device locating system 1100 is shown to include a location history module 1124. The location history module 1124 may be configured to create and/or manage a location history for devices within a building (e.g., BMS devices, mobile devices, client devices, etc.). A location history for a particular device may include a series of locations (e.g., determined by the location determination module 1120) at which the device has been located in the past. The location history module 1124 may record the locations determined by the location determination module 1120 for each device in the locations database 1122 such that a location history for a particular device can be constructed.

The location history for a mobile device may facilitate automatically selecting a user interface for monitoring and/or controlling a particular room or zone in a building, even if the mobile device is not currently in the room or zone. For example, the location history for a mobile device may be used to provide a user with a list of control interfaces from which the user can select for presentation on the mobile device. Each control interface may correspond to a building zone in which the mobile device was previously located or is currently located. This feature allows a user to readily select a control interface for a recently-visited building zone (e.g., within a predetermined time period, within a threshold number of most recently-visited locations, etc.) regardless of whether the mobile device is currently located within the building zone.

In some embodiments, the location history module 1124 stores each location in the location history with a corresponding time parameter. The time parameter may be combined with the three-dimensional location information for a device to generate four-dimensional coordinates for a device (e.g., three location coordinates and a time coordinate; two location coordinates, a floor parameter, and a time parameter, etc.). In some embodiments, the location history module 1124 stores each location determined by the location determination module 1120 as an event. Each event may include location information (e.g., two-dimensional or three-dimensional location coordinates, etc.), a time parameter (e.g., identifying a time at which the mobile device was located at the indicated location), and a device ID parameter (e.g., indicating a particular device). By storing each location as an event, the location history module 1124 can maintain a historical record of the location of a device over a period of time.

In some embodiments, the location history module 1124 is configured to use the location history for a mobile device to reconstruct a route that the mobile device travels within the building. For example, the location history module 1124 can use the location history for a mobile device assigned to a building personnel to determine whether the building personnel have physically traveled to various locations within the building at the appropriate times (e.g., for performing security checks, for personnel management, for responding to emergencies, etc.). As another example, the location history for a mobile device may allow a user's route from one building zone to another building zone to be reconstructed. This feature may be useful for providing navigation instructions (e.g., directions from one room in the building to another, directions to a BMS device, etc.) for situations in which a user is not familiar with a layout of the building. The location history for a mobile device may also be used in the event of an emergency (e.g., a fire or fire drill) to determine whether all personnel who entered the building on a particular day (e.g., the day of the emergency) have been safely evacuated.

Still referring to FIG. 11, the device locating system 1100 is shown to include an architectural building modeler 1126. The architectural building modeler 1126 may be configured to generate or obtain a three-dimensional architectural model of the building. The architectural building model may specify the physical structures and dimensions of the building (e.g., interior and exterior wall locations, window locations, stair/elevator locations, room dimensions, etc.). In some embodiments, the architectural building modeler 1126 uses existing blueprints or floor plans for the building to generate the architectural building model. For example, the architectural building modeler 1126 may receive a scanned or imported image of a blueprint or floor plan. The architectural building modeler 1126 may analyze the blueprints or floor plans to generate a three-dimensional model of the building. In other embodiments, the architectural building modeler 1126 imports the three-dimensional model from a CAD file (e.g., .dxf drawings, .dwg drawings, step drawings, etc.) or drawing generated by architecture software or design software.

In some embodiments, the architectural building modeler 1126 can be used to create a new architectural building model (e.g., generating a new model based on user input).

For example, a user may interact with the architectural building modeler 1126 to specify building dimensions (e.g., overall building dimensions, room dimensions, wall locations, etc.) and other physical or architectural attributes of the building.

In some embodiments, the architectural building modeler 1126 generates a new architectural building model based on optical imaging or other automated measurements of the building. For example, a mobile device can be used to measure wall locations and other physical structures (e.g., door locations, ceiling heights, stair locations, etc.) within the building using any of a variety of positioning or ranging techniques (e.g., optical sensing, radar, sonar, lidar, etc.). The location of the mobile device can be determined using any of the methods described above with reference to the location determination module 1120.

The mobile device may report location information (e.g., GPS coordinates, accelerometer data, altitude data, etc.), orientation information (e.g., a direction that the mobile device is facing) and/or structure detection information to the architectural building modeler 1126 at multiple different locations within the building. The architectural building modeler 1126 may generate a three-dimensional building model based on the location/orientation of the mobile device and the measured distances to various structures within the building at each of a plurality of measurement locations. The architectural building modeler 1126 may store the architectural building model in a database, such as locations database 1122.

Still referring to FIG. 11, the device locating system 1100 is shown to include a location integration module 1128. The location integration module 1128 may be configured to integrate (e.g., apply, combine, merge, etc.) the architectural building model provided by the architectural building modeler 1126 with a BMS device location information provided by the location determination module 1120. For example, the location information provided by the location determination module 1120 may define the locations of BMS devices as points floating in three-dimensional space. The location integration module 1128 may apply the locations of the BMS devices to the architectural building model generated by the architectural building modeler 1126 to map each three-dimensional location to a particular location within the building.

In some embodiments, the location determination module 1120 defines the locations of BMS devices according to a first coordinate system and the architectural building modeler 1126 defines the architecture of the building according to a second coordinate system. The location integration module 1128 may merge the first coordinate system with the second coordinate system to generate an integrated model that includes both a three-dimensional architectural representation of the building and the locations of various BMS devices.

In some embodiments, the location integration module 1128 receives calibration data. The calibration data may identify a point in the building architectural model (e.g., a three-dimensional location) that corresponds to a particular point relative to the locations of the BMS devices (i.e., a shared point between the first coordinate system and the second coordinate system). The calibration data may include multiple calibration points measured at various locations in or around the building (e.g., a location measured at a southwest corner of the building, a location measured at a northeast corner of the building, etc.). The location integration module 1128 may use the calibration data to scale and/or orient the building architectural model relative to the floating points representing the three-dimensional locations of various BMS devices. The location integration module 1128 may generate an integrated building model (e.g., a three-dimensional architectural model) that defines the architecture of the building and specifies the locations of BMS devices relative to the architecture of the building (e.g., within a wall, in a particular room or zone, on the roof, etc.).

Still referring to FIG. 11, the device locating system 1100 is shown to include a model visualization module 1130. The model visualization module 1130 may be configured to generate or provide a graphical visualization for visualizing the integrated model generated by the location integration module 1128. The model visualization module 1130 may generate a graphical visualization that includes a three-dimensional architectural model of the building with the locations of various BMS devices represented visually in the three-dimensional architectural model. The location of each BMS device may be shown relative to the architecture of the building. The model visualization module 1130 may generate a graphical visualization for display on a display or graphical user interface (GUI) (not shown) of the device locating system 1100. In one embodiment, the graphical visualization can be generated for display on a mobile device, and transmitted to the mobile device by the client services module 1110 and/or the application services module 1112.

In some embodiments, the model visualization module 1130 represents BMS devices using three-dimensional objects in the graphical visualization. For example, the model visualization module 1130 may access the device identifiers stored in the device locations database 1122 to identify a type of device located at each of the indicated locations in the integrated model. The model visualization module 1130 may retrieve three-dimensional representations of one or more device types (e.g., a CAD model of a chiller, a CAD model of an AHU, etc.) and insert the three-dimensional representations at the specified locations in the integrated model. For example, the model visualization module 1130 may represent a chiller in the graphical visualization using a three-dimensional model of a chiller positioned at the location in the building associated with the chiller.

In some embodiments, the model visualization module 1130 represents BMS devices in the graphical visualization according to equipment-specific attributes and/or status. For example, the model visualization module 1130 may interact with local or remote applications (e.g., a fault detection application) to identify fault indications for the BMS devices. In some embodiments, the model visualization module 1130 visually represents a detected fault by manipulating a visual attribute of the corresponding BMS device (e.g., highlighting BMS devices with detected faults, representing BMS devices with detected faults as flashing red, etc.). In some embodiments, the model visualization module 1130 adjusts the visual appearance of BMS devices in the graphical visualization based on an operating status (e.g., active, inactive, etc.) or performance metric (e.g., energy consumption, efficiency, etc.). For example, BMS devices that are operating efficiently may be represented using a first color (e.g., green or blue) whereas BMS devices that are operating inefficiently may be represented using a second color (e.g., yellow, orange, or red).

In some embodiments, the model visualization module 1130 represents relationships between BMS devices in the graphical visualization. For example, related BMS devices (e.g., an AHU and a VAV box that receives airflow from the AHU) may be visually associated in the graphical visualization (e.g., connected by a line, represented using the same color, etc.). In some embodiments, the model visualization module 1130 is configured to adjust the graphical visualization to allow a user to view relationships between BMS devices. For example, the model visualization module 1130 may highlight or emphasize BMS devices that are related to a user-selected BMS device.

The graphical visualization provided by the model visualization module 1130 may facilitate locating a particular BMS device for service or maintenance. For example, service personnel can access the graphical visualization provided by the model visualization module 1130 to identify a specific location of a faulty BMS device (e.g., above a particular ceiling tile, within a wall six feet from the corner of a room, etc.). The specific locations provided by the model visualization module 1130 define the locations of BMS devices more precisely and more accurately relative to traditional systems (e.g., systems which specify only a room location or general physical location). Advantageously, the specific locations provided by the model visualization module 1130 may allow BMS devices to be readily located without requiring service personnel to search in a general location.

The model visualization module 1130 may interact with client services 1110, application services 1112, and/or local applications 1118 to provide the visualization of the integrated model to local or remote clients (e.g., UI clients, remote applications, etc.). A user can access the graphical visualization locally or remotely to view the attributes, status, relationships, locations, and other information associated with various BMS devices. For example, the model visualization module 1130 may generate a graphical visualization for display on a display or graphical user interface (GUI) (not shown) of the device locating system 1100. In one embodiment, the graphical visualization can be generated for display on a mobile device, and transmitted to the mobile device using the client services 1110, the application services 1112, and/or the local applications 1118.

Still referring to FIG. 11, the device locating system 1100 is shown to include an equipment association module 1132. The equipment association module 1132 may be configured to automatically associate BMS devices and/or recommend device associations based on the locations of the BMS devices. The equipment association module 1132 may generate associations between BMS devices (i.e., associating one BMS device with another BMS device) or between a BMS device and a building zone. For each BMS device, the equipment association module 1132 may determine one or more nearby BMS devices based on the device locations determined by the location determination module 1120.

In some embodiments, the equipment association module 1132 populates a list of nearby BMS devices (e.g., sorted by Euclidian distance). The equipment association module 1132 may populate a relationship table with nearby devices that could potentially be related. For example, if the BMS device is a thermostat, the relationship table may include a potential relationship between the thermostat and a nearby VAV box. In some embodiments, the equipment association module 1132 suggests a list of likely relationships between BMS devices (e.g., ranked based on distance and/or relevance) for a user to confirm or reject. In other embodiments, the equipment association module 1132 automatically associates BMS devices without requiring user intervention.

In some embodiments, the equipment association module 1132 generates associations between BMS devices and building zones. The equipment association module 1132 may identify a room or zone in which a BMS device is located using the integrated architectural model generated by the location integration module 1128. In some embodiments, the equipment association module 1132 automatically generates a building object for the building zone (e.g., using building object templates). The equipment association module 1132 may associate a nearby BMS device with the building zone by adding an input or output of the BMS device as an attribute of the building zone.

In some embodiments, the equipment association module 1132 provides a graphical visualization to a user (e.g., a service or installation technician) to facilitate forming associations between BMS devices and/or building zones. In one embodiment, the graphical visualization is a GUI which allows for both graphical visualization to be presented to the user, and for user input via the GUI. The graphical visualization may display recommended device associations based on the location of the equipment. For example, the graphical visualization may include the integrated three-dimensional model generated by the location integration module 1128. Recommended device associations may be shown by lines (e.g., augmented reality lines) connecting BMS devices in the integrated model. The user can confirm or reject the recommended associations via the graphical visualization.

Advantageously, the location-based equipment associations formed or recommended by the equipment association module 1132 may facilitate automated device pairing for wireless devices. For example, the equipment association module 1132 may automatically associate a wireless thermostat with a particular building zone or with another BMS device (e.g., a VAV box for the room in which the thermostat is located) based on the location of the wireless thermostat in the building. If the wireless thermostat is located in the same room or zone as a VAV box, the equipment association module may automatically associate the wireless thermostat with the VAV box.

Still referring to FIG. 11, the device locating system 1100 is shown to include an equipment addressing module 1134. The equipment addressing module 1134 may be configured to automatically address building equipment based on the location of the equipment. The equipment addressing module 1134 may access the locations database 1122 to determine the locations of BMS devices in the building. The equipment addressing module 1134 may assign unique parameters to building equipment (e.g., a MAC address, a device name, a device identifier, etc.) during commissioning and/or installation (e.g., a new installation or a retrofit installation). The unique parameters assigned to a BMS device by the equipment addressing module 1134 may be guaranteed to be different for various BMS devices.

The equipment addressing module 1134 may assign a device name to a BMS device according to a naming convention based on the location of the BMS device and/or the room or building zone in which the BMS device is located. For example, the equipment addressing module 1134 may name a VAV box "VAV.B1_F3_CR5" if the VAV box is located in conference room 5 on floor 3 of building 1. Advantageously, automatically assigning device names to various BMS devices avoids requiring technicians to set unique addresses for all equipment using a manual dip switch.

Still referring to FIG. 11, the device locating system 1100 is shown to include an augmented reality module 1136. In various embodiments, the augmented reality module 1136 may be a component of the device locating system 1100 and/or a mobile device. For example, the augmented reality module 1136 may be a program module of an application running on the mobile device. The augmented reality module 1136 may be configured to generate an augmented reality display of the integrated model generated by the location integration module 1128. For example, the augmented reality module 1136 may be configured to generate an augmented reality view of the building equipment locations in the integrated model from the perspective of an observer (e.g., a mobile device) within the building.

The augmented reality module 1136 may generate a display of the building equipment superimposed or projected upon a live camera-derived image from a mobile device within the building. The augmented reality display may allow a user to see building equipment that is hidden behind walls or located in a ceiling or floor. For example, a user can point a mobile device with a camera (e.g., a smart phone, a tablet, etc.) toward a wall that has building equipment located on the other side.

The augmented reality module 1136 may be configured to determine the location and orientation of the mobile device in order to generate a view of the building equipment from the perspective of the mobile device. The location of the mobile device can be determined using any of the methods described above with reference to the location determination module 1120. The orientation of the mobile device can be determined using an accelerometer and/or compass integrated within the mobile device. For example, the mobile device may report location information (e.g., GPS coordinates, accelerometer data, altitude data, etc.) and orientation information (e.g., a direction that the mobile device is facing) to the augmented reality module 1136. The augmented reality module 1136 may superimpose a view of the building equipment from the perspective of the mobile device upon the camera-derived image such that the building equipment is visible in the augmented reality display.

In some embodiments, the augmented reality module 1136 represents BMS devices in the augmented reality display according to equipment-specific attributes and/or status. For example, the augmented reality module 1136 may interact with local applications (e.g., a fault detection application) to identify fault indications for the BMS devices. In some embodiments, the augmented reality module 1136 visually represents a detected fault by manipulating a visual attribute of the corresponding BMS device (e.g., highlighting BMS devices with detected faults, representing BMS devices with detected faults as flashing red, etc.) in the augmented reality display.

In some embodiments, the augmented reality module 1136 adjusts the visual appearance of BMS devices in the augmented reality display based on an operating status (e.g., active, inactive, etc.) or a performance metric (e.g., energy consumption, efficiency, etc.). For example, BMS devices that are operating efficiently may be represented using a first color (e.g., green or blue) whereas BMS devices that are operating inefficiently may be represented using a second color (e.g., yellow, orange, or red) in the augmented reality display. In some embodiments, the augmented reality module 1136 represents relationships between BMS devices in the augmented reality display. For example, related BMS devices (e.g., an AHU and a VAV box that receives airflow from the AHU) may be visually associated in the augmented reality display (e.g., connected by an augmented reality line, etc.).

Advantageously, the augmented reality display provided by the augmented reality module 1136 may facilitate locating a particular BMS device for service or maintenance. For example, service personnel can use the augmented reality display to locate a faulty BMS device that is hidden from view (e.g., within a wall, above a ceiling tile, etc.). The augmented reality display may allow BMS devices to be readily located without requiring service personnel to search in a general location. In one embodiment, the augmented reality display provided by the augmented reality module 1136 allows a user to select a particular BMS device, and have the BMS device issue a sound to further aid the user in locating the BMS device. In one example, the BMS device can vary the volume of the sound such that the sound increases in volume as the mobile device (i.e. the user) is positioned closer to the BMS device, thereby guiding a user to the BMS device.

Figure 12:
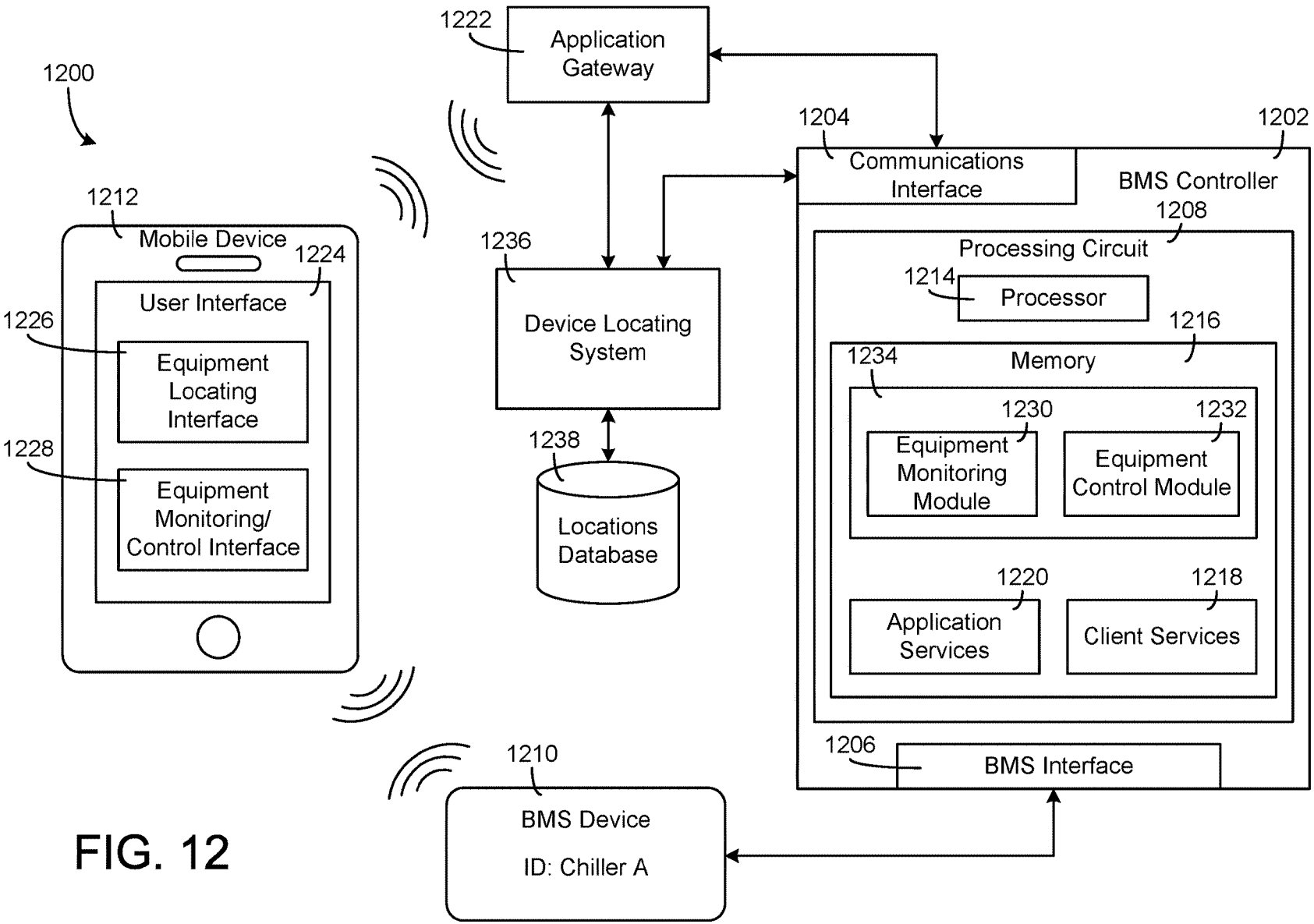
FIG. 12 is a block diagram of a monitoring and control system for building equipment, according to an exemplary embodiment.

Referring now to FIG. 12, a block diagram of a system 1200 for monitoring and controlling building equipment is shown, according to one embodiment. System 1200 is shown to include a BMS controller 1202. In some embodiments, the BMS controller 1202 is the same or similar to BMS controller 366, as described with reference to FIGS. 3-4. The BMS controller 1202 is shown to include a communications interface 1204, a BMS interface 1206, and a processing circuit 1208.

The communications interface 1204 may facilitate communications between the BMS controller 1202 and external applications (e.g., monitoring and reporting applications, enterprise control applications, remote systems and applications, applications residing on client devices, etc.) for allowing user control, monitoring, and adjustment to the BMS controller 1202 and/or a BMS device 1210 controlled by the BMS controller 1202. The communications interface 1204 may also facilitate communications between the BMS controller 1202 and a mobile device 1212. The BMS interface 1206 may facilitate communications between the BMS controller 1202 and various building subsystems (e.g., HVAC, lighting security, lifts, power distribution, business, etc.) that include various BMS devices, such as BMS device 1210. In some embodiments, the communications interface 1204 and the BMS interface 1206 are the same or similar to communications interface 407 and BMS interface 409, respectively, as described with reference to FIG. 4.

The processing circuit 1208 is shown to include a processor 1214 and a memory 1216. The processor 1214 may be a general purpose or specific purpose processor, an application specific integrated circuit (ASIC), one or more field programmable gate arrays (FPGAs), a group of processing components, or other suitable processing components. The processor 1214 is configured to execute computer code or instructions stored in memory or received from other computer readable media (e.g., CDROM, network storage, a remote server, etc.).

The memory 1216 may include one or more devices (e.g., memory units, memory devices, storage devices, etc.) for storing data and/or computer code for completing and/or facilitating the various processes described in the present disclosure. The memory 1216 may include random access memory (RAM), read-only memory (ROM), hard drive storage, temporary storage, non-volatile memory, flash memory, optical memory, or any other suitable memory for storing software objects and/or computer instructions. The memory 1216 may include database components, object code components, script components, or any other type of information structure for supporting the various activities and information structures described in the present disclosure. The memory 1216 may be communicably connected to the processor via the processing circuit 1208 and may include computer code for executing (e.g., by the processor 1214) one or more processes described herein. When the processor 1214 executes instructions stored in the memory 1216, the processor 1214 generally configures the BMS controller 1202 (and more particularly the processing circuit 1208) to complete such activities.

Still referring to FIG. 12, the BMS controller 1202 is shown to include a client services module 1218 and an application services module 1220. The client services module 1218 may be configured to facilitate interaction and/or communication between the BMS controller 1202 and various internal or external clients or applications. For example, the client services module 1218 may include web services or application programming interfaces available for communication by UI clients and remote applications (e.g., applications running on a mobile device, energy monitoring applications, applications allowing a user to monitor the performance of the BMS, automated fault detection and diagnostics systems, etc.). The application services module 1220 may facilitate direct or indirect communications between remote applications, local applications, and the BMS controller 1202. For example, the application services module 1220 may allow the BMS controller 1202 to communicate (e.g., over a communications network) with remote applications running on mobile devices and/or with other BMS controllers.

In some embodiments, the application services module 1220 communicates with UI clients and/or remote applications via an applications gateway 1222 using the communications interface 1204 of the BMS controller 1202. For example, the application services module 1220 may be configured to receive communications (e.g., detected emitter identifiers) from applications running the mobile device 1212 via the application gateway 1222. In some embodiments, the application services module 1220 are configured to receive a request for a graphical visualization for presentation on a user interface 1224 of the mobile device 1212. The request may include an emitter identifier associated with one of the plurality of wireless emitters detected by the mobile device 1212. The client services module 1218 may provide the mobile device 1212 with a location-specific graphical visualization for display on the user interface 1224 (e.g., based on the emitter identifier) in response to the request.

In some embodiments, the graphical visualization presented on the user interface 1224 of the mobile device 1212 includes an equipment locating interface 1226. The equipment locating interface 1226 may include a GUI that allows a user to search for particular BMS devices using the mobile device 1212. For example, the equipment locating interface 1226 may facilitate searching for BMS devices by device name (e.g., device ID), device type, device location, fault status, operating state, or any other variable or fixed parameter describing the BMS devices. In some embodiments, the equipment locating interface 1226 facilitates identifying one or more nearby BMS devices 1210 based on the locations of the BMS devices 1210 relative to the mobile device 1212.

In some embodiments, the graphical visualization presented on the user interface 1224 of the mobile device 1212 includes an equipment monitoring/control interface 1228. The equipment monitoring/control interface 1228 may be configured to interact with the BMS controller 1202 for monitoring the status of the BMS controller 1202 and/or the BMS device 1210. For example, the equipment monitoring/control interface 1228 may be used to monitor one or more measured or calculated variables tracked by the BMS controller 1202 (e.g., temperature, energy consumption, control setpoints, fault status, etc.). The equipment monitoring/control interface 1228 may also be used to control the BMS devices 1210. For example, the equipment monitoring/control interface 1228 may interact with an equipment monitoring module 1230 and/or an equipment control module 1232 of the BMS controller 1202.

Throughout this disclosure, the equipment monitoring module 1230 and the equipment control module 1232 of the BMS controller 1202 are referred to collectively as building control services modules 1234. The building control services modules 1234 may be configured to automatically control the BMS controller 1202 and the various subsystems thereof. The building control services module 1234 may utilize closed loop control, feedback control, PI control, model predictive control, or any other type of automated building control methodology to control the environment (e.g., a variable state or condition) within the building. In some embodiments, the building control services modules 1234 interact with the equipment monitoring/control interface 1228 presented on the user interface 1224 of the mobile device to facilitate user monitoring and/or control of the BMS devices 1210.

The building control services modules 1234 may receive inputs from sensory devices (e.g., temperature sensors, pressure sensors, flow rate sensors, humidity sensors, electric current sensors, cameras, radio frequency sensors, microphones, etc.), user input devices (e.g., computer terminals, client devices, user devices, etc.) or other data input devices via the BMS interface 1206. The building control services modules 1234 may apply the various inputs to a building energy use model and/or a control algorithm to determine an output for one or more building control devices (e.g., dampers, air handling units, chillers, boilers, fans, pumps, etc.) in order to affect a variable state or condition within the building (e.g., zone temperature, humidity, air flow rate, etc.).

In some embodiments, the building control services modules 1234 are configured to control the environment of the building on a zone-individualized level. For example, the building control services modules 1234 may control the environment of two or more different building zones using different setpoints, different constraints, different control methodology, and/or different control parameters. The building control services modules 1234 may operate the BMS devices to maintain building conditions (e.g., temperature, humidity, air quality, etc.) within a setpoint range, to optimize energy performance (e.g., to minimize energy consumption, to minimize energy cost, etc.), and/or to satisfy any constraint or combination of constraints as may be desirable for various implementations.

In some embodiments, the building control services modules 1234 use the location of various BMS devices to translate an input received from a building system into an output or control signal for the building system. The building control services modules 1234 may receive location information for BMS devices from a device locating system 1236. In one embodiment, the device locating system 1236 accesses device location information stored in a locations database 1238. In some embodiments, the building control services modules 1234 automatically set or recommend control parameters for the BMS devices based on the locations of the BMS devices. For example, the building control services modules may automatically set a flow rate setpoint for a VAV box based on the size of the building zone in which the VAV box is located.

The building control services modules 1234 may determine which of a plurality of sensors to use in conjunction with a feedback control loop based on the locations of the sensors within the building. For example, the building control services modules 1234 may use a signal from a temperature sensor located in a building zone as a feedback signal for controlling the temperature of the building zone in which the temperature sensor is located. In some embodiments, the building control services modules 1234 automatically generate control algorithms for a BMS device or a building zone based on the location of the zone in the building. For example, the building control services modules 1234 may be configured to predict a change in demand resulting from sunlight entering through windows based on the orientation of the building and the locations of the building zones (e.g., east-facing, west-facing, perimeter zones, interior zones, etc.).

The building control services modules 1234 may use zone location information and interactions between adjacent building zones (rather than considering each zone as an isolated system) to more efficiently control the temperature and/or airflow within the building. For control loops that are conducted at a larger scale (i.e., floor level) the building control services modules 1234 may use the location of each building zone and/or BMS device to coordinate control functionality between building zones. For example, the building control services modules 1234 may consider heat exchange and/or air exchange between adjacent building zones as a factor in determining an output control signal for the building zones.

In some embodiments, the building control services modules 1234 are configured to optimize the energy efficiency of a building using the locations of various BMS devices and the control parameters associated therewith. The building control services modules 1234 may be configured to achieve control setpoints using building equipment with a relatively lower energy cost (e.g., by causing airflow between connected building zones) in order to reduce the loading on building equipment with a relatively higher energy cost (e.g., chillers and roof top units). For example, the building control services modules 1234 may be configured to move warmer air from higher elevation zones to lower elevation zones by establishing pressure gradients between connected building zones.

In some embodiments, the building control services modules 1234 are configured to generate location-based energy savings recommendations for particular building zones. For example, the building control services modules 1234 may determine a change in heating or cooling demand resulting from sunlight entering through windows of perimeter building zones based on the orientation of the building and the locations of the building zones. The building control services modules 1234 may recommend a control strategy for a window control system (e.g., opening and closing window shades at particular times) in order to reduce the amount of energy required to heat or cool the perimeter building zones.

In some embodiments, the building control services modules 1234 are configured to only allow for monitoring or control of a BMS device or subsystem when the mobile device 1212 is determined to be within a certain distance of the BMS device or subsystem. For example, the building control services modules 1234 can be used to control BMS device 1210 only when the mobile device 1212 is determined to be within a predetermined distance of the BMS device 1210. The predetermined distance may be five feet, ten feet, fifteen feet, etc. Further, the building control services modules 1234 may be configured to limit the type of monitoring and/or control available to a user via the mobile device 1212 based on the distance of the mobile device 1212 to the BMS device 1210. For example, a first distance (e.g. fifty feet) may be the distance within which parameters of the BMS device 1210 may be monitoring. However, a second distance (e.g. five feet) may be the distance within which the BMS device 1210 may be controlled using the mobile device 1212. Further, some controls may require the mobile device to be closer than five feet from the BMS device 1210, such as where close monitoring of the BMS device 1210 may be required.

In some embodiments, the building control services modules 1234 are configured to alert a user of the mobile device 1212 when the user is within a given distance to a BMS device. The building control services modules 1234 may have access to a preventative maintenance schedule for the BMS device, and can alert a maintenance personnel that preventative maintenance is due on a BMS device when the mobile device 1212 associated with the maintenance personnel is determined to be within a predetermined distance of the BMS device (e.g. ten feet, fifty feet, etc.). Alternatively, the building control services modules 1234 may alert the maintenance personnel using the mobile device 1212, when the mobile device 1212 is determined to be in the same building as the BMS device. In a further embodiment, the building control services modules 1234 are configured to push status alerts to a mobile device 1212 when the mobile device 1212 is determined to be within a predetermined distance of the BMS device. Status alerts can include faults, warnings, required software or firmware updates, maintenance requirements, etc.

Figure 13:
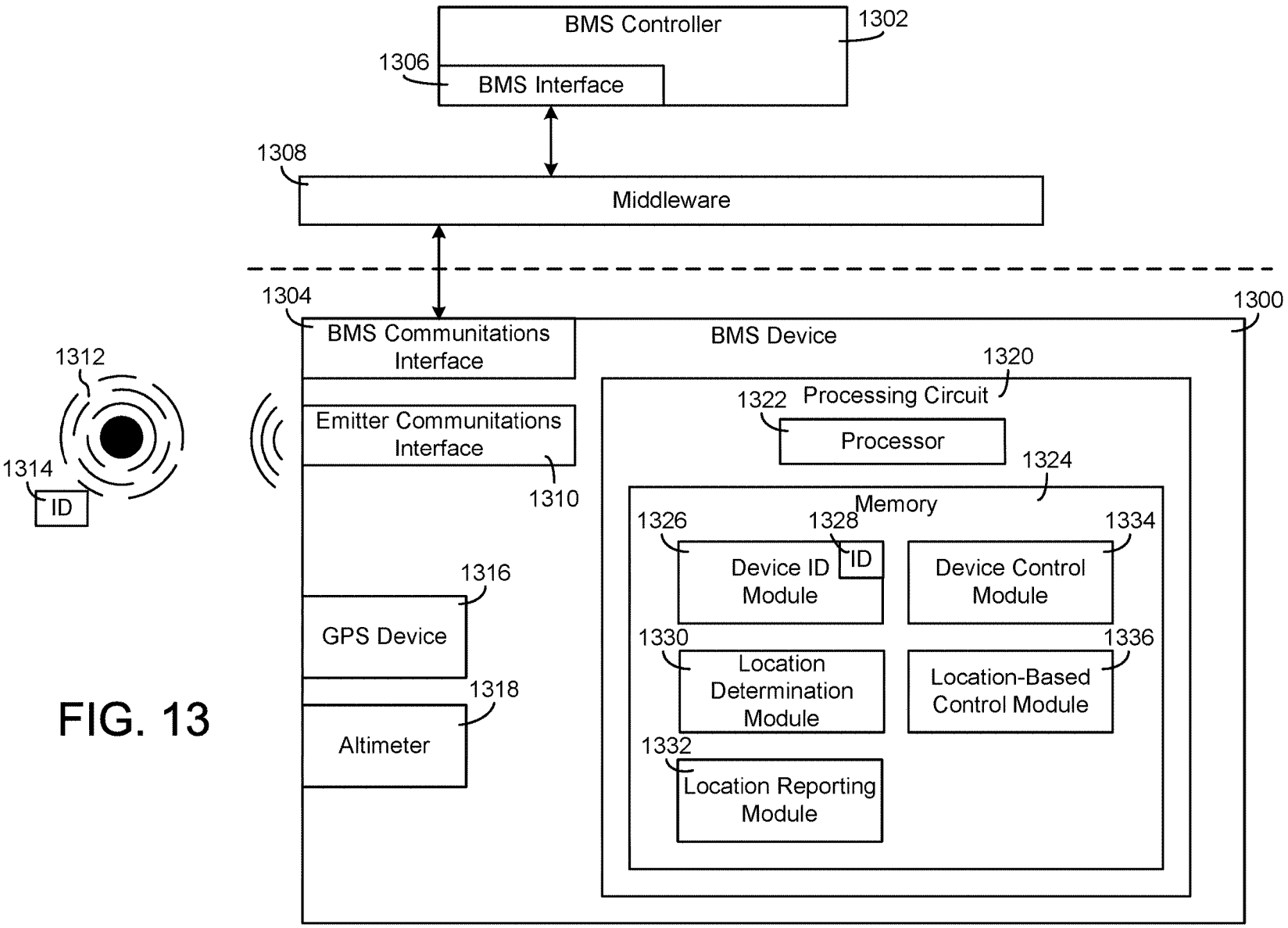
FIG. 13 is a block diagram of a BMS device configured to determine and report its own location, according to an exemplary embodiment.

Referring now to FIG. 13, a block diagram illustrating a BMS device 1300 in greater detail is shown, according to an exemplary embodiment. The BMS device 1300 may be any device of a building management system (e.g., a chiller, an AHU, a VAV, a thermostat, a shade controller, a HVAC controller, etc.) as previously described with reference to FIGS. 1-4. The BMS device 1300 may be configured to determine its own three-dimensional location and to report its three-dimensional location to a BMS controller 1302. In some embodiments, the BMS device 1300 is a SMART device configured to perform some or all of the data analysis and/or control functions required for controlling a portion of the building management system (e.g., zone level control). For example, the BMS device 1300 may be able to provide a time-series roll up of various data over a period of time to the BMS controller 1302. The control operations performed by the BMS device 1300 may be based on the location of the BMS device 1300 (e.g., location-based control) as determined automatically by the BMS device 1300 and/or the BMS controller 1302.

The BMS device 1300 is shown to include a BMS communications interface 1304. The BMS communications interface 1304 may include wired or wireless interfaces (e.g., jacks, antennas, transmitters, receivers, transceivers, wire terminals, etc.) for conducting data communications with various systems, devices, or networks of the building management system. In some embodiments, the BMS communications interface 1304 is configured to communicate using a Building Automation and Control network (BACnet) communications protocol. The BMS communications interface 1304 may facilitate direct or indirect electronic data communications with other components of the building management system (e.g., the BMS controller, other BMS devices, etc.). In some embodiments, the BMS communications interface 1304 includes an Ethernet card and port for sending and receiving data via an Ethernet-based communications network and/or a WiFi transceiver for communicating via a wireless communications network. The BMS communications interface 1304 may be configured to communicate via local area networks, wide area networks (e.g., the Internet, a building WAN, etc.), and/or direct wired or wireless communications.

The BMS communications interface 1304 may be configured to receive building management inputs directly from the BMS controller 1302 via the BMS interface 1306 or indirectly via middleware 1308. Middleware may include services that allow interoperable communication to, from, or between disparate BMS subsystems of the building management system (e.g., HVAC systems from different manufacturers, HVAC systems that communicate according to different protocols, security/fire systems, IT resources, door access systems, etc.). Middleware may be, for example, an EnNet server sold by Johnson Controls, Inc. The BMS interface and/or middleware can include any number of software buffers, queues, listeners, filters, translators, or other communications-supporting services.

Still referring to FIG. 13, the BMS device 1300 is shown to include an emitter communications interface 1310. The emitter communications interface 1310 may be configured to detect wireless signals emitted by the wireless emitters/receivers 1312 positioned at various locations within or around a building. The emitter communications interface 1310 may use any type wireless technology or communications protocol. For example, the emitter communications interface 1310 may be configured to detect wireless signals emitted by Bluetooth low energy (BLE) emitters, near field communications (NFC) devices, WiFi transceivers, RFID devices, ultrawide band (UWB) devices, infrared emitters/sensors, visible light communications (VLC) devices, ultrasound devices, cellular transceivers, iBeacons, or any other type of hardware configured to emit a wireless signal.

The emitter communications interface 1310 may detect a wireless signal that includes an indication of an emitter identifier 1314 associated with a particular wireless emitter/receiver 1312. In some embodiments, the wireless signal broadcast by the emitter/receiver 1312 include multiple emitter identifiers 1314 (e.g., a UUID value, a major value, a minor value, etc.). The BMS device 1300 may be configured to identify the emitter identifier(s) 1314 associated with the wireless signal received via the emitter communications interface 1312. The identified emitter identifier(s) 1314 may be used by the BMS device 1300 to determine its location within the building, as previously described with reference to FIGS. 7-8.

Still referring to FIG. 13, the BMS device 1300 is shown to include a GPS device 1316 and an altimeter 1318. The GPS device 1316 may include a GPS receiver in communication with GPS satellites. The BMS device 1300 may use GPS information received via the GPS device 1316 to determine its own geospatial position. In various embodiments, the information from the GPS device 1316 may be used to calculate a two-dimensional position (e.g., two-dimensional GPS coordinates, latitude and longitude, etc.) a three-dimensional position (e.g., GPS coordinates and an altitude), or a four-dimensional position (e.g., a three-dimensional location and a time).

The altimeter 1318 may be configured to measure an altitude. In some embodiments, the BMS device 1300 uses altimeter data in conjunction with GPS data to determine its own three-dimensional location. For example, the GPS device 1316 may provide two-dimensional (e.g., horizontal) coordinates and the altimeter 1318 may provide a one-dimensional (e.g., vertical) altitude. The BMS device 1300 may combine the altimeter data and the GPS data to determine a three-dimensional location.

Still referring to FIG. 13, the BMS device 1300 is shown to include a processing circuit 1320 including a processor and memory. The processing circuit is shown to include a processor 1322 and a memory 1324. The processor 1322 may be a general purpose or specific purpose processor, an application specific integrated circuit (ASIC), one or more field programmable gate arrays (FPGAs), a group of processing components, or other suitable processing components. The processor 1322 is configured to execute computer code or instructions stored in the memory or received from other computer readable media (e.g., CDROM, network storage, a remote server, etc.).

The memory 1324 may include one or more devices (e.g., memory units, memory devices, storage devices, etc.) for storing data and/or computer code for completing and/or facilitating the various processes described in the present disclosure. The memory 1324 may include random access memory (RAM), read-only memory (ROM), hard drive storage, temporary storage, non-volatile memory, flash memory, optical memory, or any other suitable memory for storing software objects and/or computer instructions. The memory 1324 may include database components, object code components, script components, or any other type of information structure for supporting the various activities and information structures described in the present disclosure. The memory 1324 may be communicably connected to the processor 1322 via the processing circuit 1320 and may include computer code for executing (e.g., by the processor 1322) one or more processes described herein. When the processor 1322 executes instructions stored in the memory 1324, the processor 1322 generally configures the BMS device 1300 (and more particularly the processing circuit 1320) to complete such activities.

Still referring to FIG. 13, the BMS device 1300 is shown to include a device ID module 1326. The device ID module 1326 may be configured to store a device identifier 1328 (i.e., a device ID information) for the BMS device 1300. The device ID information 1328 may be a device name (e.g., "Chiller A") or other identifier that distinguishes the BMS device 1300 from other BMS devices of the building management system. In some embodiments, the device ID 1328 includes device-specific attributes such as a serial number, an equipment model number, an equipment version, an equipment definition, or other information that identifies and/or defines the BMS device 1300. The device ID information 1328 stored in the device ID module 1326 may identify a particular BMS device within a logical network (e.g., a data points network) managed by the BMS controller 1302. The device ID information 1328 may be reported to the BMS controller 1302 in conjunction with location information for the BMS device 1300. The BMS controller 1302 may use the device ID information 1328 and location information to associate the BMS device 1300 with a particular location within the building.

The BMS device is shown to include a location determination module 1330. The location determination module 1330 is a component of the BMS device 1300 and can be used by the BMS device 1300 to automatically determine its own location without requiring interaction with the BMS controller 1302 and/or a device locating system. The location determination module 1330 may be configured to determine the location of the BMS device 1300 in or around a building. In some embodiments, the location determination module 1330 determines the location of the BMS device 1300 using information received via the emitter communications interface 1310, the GPS device 1316, and/or the altimeter 1318.

The location determination module 1330 may receive one or more emitter identifiers 1314 from the emitter communications interface 1310. For example, the emitter communications interface 1310 may detect emitter identifiers 1314 broadcast by nearby wireless emitters/receivers 1312 and provide the detected emitter identifiers 1314 the location determination module 1330. If the BMS device 1300 is within range of multiple wireless emitters/receivers, the location determination module may receive multiple emitter identifiers. For embodiments in which the location determination module 1330 receives multiple emitter identifiers, each emitter identifier may be received in conjunction with a signal strength. The signal strength associated with an emitter identifier may indicate a relative proximity of the BMS device 1300 to the corresponding wireless emitter (e.g., high signal strengths indicating a closer proximity and low signal strengths indicating a more distant proximity).

The location determination module 1330 may determine the location of the BMS device 1300 based on the received emitter identifier(s) 1314. In some embodiments, the location determination module 1330 uses the emitter identifier(s) 1314 to determine which of the plurality of wireless emitters/receivers is closest to the BMS device 1300 (e.g., based on signal strength, triangulation, etc.). For example, the location determination module 1330 may use an emitter identifier as an input to a relational database (e.g., a lookup table, a device mapping, etc.). Each emitter identifier may uniquely indicate a particular wireless emitter (e.g., by emitter device name, by serial number, etc.) and/or a particular location (e.g., a zone name, a zone identifier, etc.) in the relational database. The location determination module 1330 may use the locations of the detected wireless emitters/receivers to determine the location of the BMS device 1300.

In some embodiments, the location determination module 1330 receives GPS data and/or altimeter data from the GPS device 1316 and/or the altimeter 1318. The location determination module 1330 may use the GPS information and/or altimeter information to determine a three-dimensional location of the BMS device 1300. The location determination module 1330 may be configured to associate the three-dimensional location of the BMS device 1300 with the device identifier 1328 stored in the device ID module 1326 and to store the association in a locations database. The location of the BMS device 1300 determined by the location determination module 1330 may be used for location-based control functions (e.g., performed by the location-based control module) and/or reported to the BMS controller 1302.

Still referring to FIG. 13, the BMS device 1300 is shown to include a location reporting module 1332. The location reporting module 1332 may be configured to report the location of the BMS device 1300 to the BMS controller 1302. In various embodiments, the location reporting module 1332 may report a two-dimensional location (e.g., x and y coordinates, GPS coordinates, etc.), a three-dimensional location (e.g., x, y, and z coordinates, GPS coordinates and altimeter data, two-dimensional coordinates and a floor number, etc.), or a four-dimensional location, (e.g., x, y, and z coordinates and a time parameter; GPS coordinates, altimeter data, and a time parameter; etc.). In some embodiments, the location reporting module 1332 reports the location of the BMS device 1300 as a relative location within a building (e.g., within particular room or zone, in a wall, ceiling, or floor, etc.).

In some embodiments, the location reporting module 1332 reports the location of the BMS device 1300 in conjunction with a device identifier 1328. For example, the location reporting module 1332 may retrieve the device identifier 1328 from the device ID module 1326 and report the device ID 1328 along with the location information from the location determination module 1330. The BMS controller 1302 may use the device ID 1328 and location information to associate the BMS device 1300 with a particular location within the building.

In some embodiments, the location reporting module 1332 reports information that can be used to determine the location of the BMS device 1300 (e.g., for embodiments in which the BMS device does not determine its own location). For example, the location reporting module 1332 may report one or more detected emitter identifiers, signal strengths associated with each detected emitter identifier, GPS data, altitude data, or other data obtained by the BMS device 1300. The BMS controller 1302 may use the reported information to determine the location of the BMS device 1300 as previously described.

Still referring to FIG. 13, the BMS device 1300 is shown to include a device control module 1334. The device control module 1334 may be configured to manage various control functions that can be performed by the BMS device 1300 to automatically control the environment within the building or a portion thereof. In some embodiments, the device control module 1334 performs control operations on a zone-specific level or device-specific level. The device control module 1334 may allow the BMS device 1300 to perform control operations without requiring an input signal from a supervisory controller such as the BMS controller 1302 (e.g., for embodiments in which the BMS device includes SMART equipment). Additionally, the device control module 1334 may allow the BMS device 1300 to control or monitor other BMS devices coupled to the BMS device 1300. In one embodiment, the other BMS devices are coupled to the BMS device 1300 via a network through the BMS communications network 1304. The BMS communications interface 1304 may be configured to communicate via local area networks, wide area networks (e.g., the Internet, a building WAN, etc.), and/or direct wired or wireless communications.

The device control module 1334 may receive inputs from sensory devices (e.g., temperature sensors, pressure sensors, flow rate sensors, humidity sensors, electric current sensors, cameras, radio frequency sensors, microphones, etc.), user input devices (e.g., computer terminals, client devices, user devices, etc.) or other data input devices via the BMS communications interface 1304. The device control module 1334 may apply the various inputs to a building energy use model and/or a control algorithm to determine an output for one or more building control devices (e.g., dampers, air handling units, chillers, boilers, fans, pumps, etc.) in order to affect a variable state or condition within the building (e.g., zone temperature, humidity, air flow rate, etc.). The device control module 1334 may utilize closed loop control, feedback control, PI control, model predictive control, or any other type of automated building control methodology to control the environment (e.g., a variable state or condition) within the building.

In some embodiments, the device control module 1334 is configured to control the environment of a building on a zone-individualized level. For example, the device control module 1334 may control the environment of two or more different building zones using different setpoints, different constraints, different control methodology, and/or different control parameters. The device control module 1334 may operate one or more BMS devices of the building management system to maintain building conditions (e.g., temperature, humidity, air quality, etc.) within a setpoint range, to optimize energy performance (e.g., to minimize energy consumption, to minimize energy cost, etc.), and/or to satisfy any constraint or combination of constraints as may be desirable for various implementations.

Still referring to FIG. 13, the BMS device 1300 is shown to include a the location-based control module 1336. The location-based control module 1336 may be configured to perform location-based control operations for the BMS device 1300. In some embodiments, the location-based control module 1336 uses the location of the BMS device 1300 to translate an input signal into an output or control signal. The location-based control module 1336 may receive location information for the BMS device 1300 from the location determination module 1330. In some embodiments, the location-based control module 1336 automatically sets or recommends control parameters for the BMS device 1300 based on the location of the BMS device 1300 within a building. For example, if the BMS device 1300 is a VAV box, the location-based control module 1336 may automatically set a flow rate setpoint for the VAV box based on the size of the building zone in which the VAV box is located.

The location-based control module 1336 may determine which of a plurality of sensors to use in conjunction with a feedback control loop based on the locations of the sensors within a building. For example, the location-based control module 1336 may use a signal from a temperature sensor located in a building zone as a feedback signal for controlling the temperature of the building zone in which the temperature sensor is located. The location-based control module 1336 may automatically associate the BMS device 1300 with one or more input devices (e.g., sensors) and one or more control devices (e.g., actuators) based on the locations of the devices within the building.

In some embodiments, the location-based control module 1336 automatically generates control algorithms for the BMS device 1300 based on the location of the BMS device 1300 in the building. For example, the location-based control module 1336 may be configured to predict a change in demand resulting from sunlight entering through windows based on the orientation of the building and the locations of the building zones (e.g., east-facing, west-facing, perimeter zones, interior zones, etc.). The location-based control module 1336 may adjust the control algorithms used by the device control module 1334 to control the BMS device 1300 based on the location of the BMS device 1300 within a building.

The location-based control module 1336 may use zone location information and interactions between adjacent building zones (rather than considering each zone as an isolated system) to more efficiently control the temperature and/or airflow within the building. For control loops that are conducted at a larger scale (i.e., floor level) the location-based control module 1336 may use the location of the BMS device 1300 and other BMS devices to coordinate control functionality between building zones. For example, the location-based control module 1336 may consider heat exchange and/or air exchange between adjacent building zones as a factor in determining an output control signal for the BMS device. 1300 The location-based control module 1336 may adjust the output control signal provided to various devices based on the locations of such devices within the building.

In some embodiments, the location-based control module 1336 is configured to optimize the energy efficiency of a building using the location of the BMS device 1300 and the control parameters associated therewith. The location-based control module 1336 may be configured to achieve control setpoints using building equipment with a relatively lower energy cost (e.g., by causing airflow between connected building zones) in order to reduce the loading on building equipment with a relatively higher energy cost (e.g., chillers and roof top units). For example, the location-based control module 1336 may be configured to move warmer air from higher elevation zones to lower elevation zones by establishing pressure gradients between connected building zones.

In some embodiments, the location-based control module 1336 is configured to generate location-based energy savings recommendations for particular building zones. For example, the location-based control module 1336 may determine a change in heating or cooling demand resulting from sunlight entering through windows of perimeter building zones based on the orientation of the building and the locations of the building zones. The location-based control module 1336 may recommend a control strategy for a window control system (e.g., opening and closing window shades at particular times) in order to reduce the amount of energy required to heat or cool the perimeter building zones.

Referring now to FIGS. 14-22 several exemplary user interfaces that can be presented via a mobile device are shown, according to an exemplary embodiment. In some embodiments, these interfaces are generated by an application running on the mobile device. In other embodiments, the interfaces are generated by a component of the device locating system and/or a BMS controller.

Figure 15:
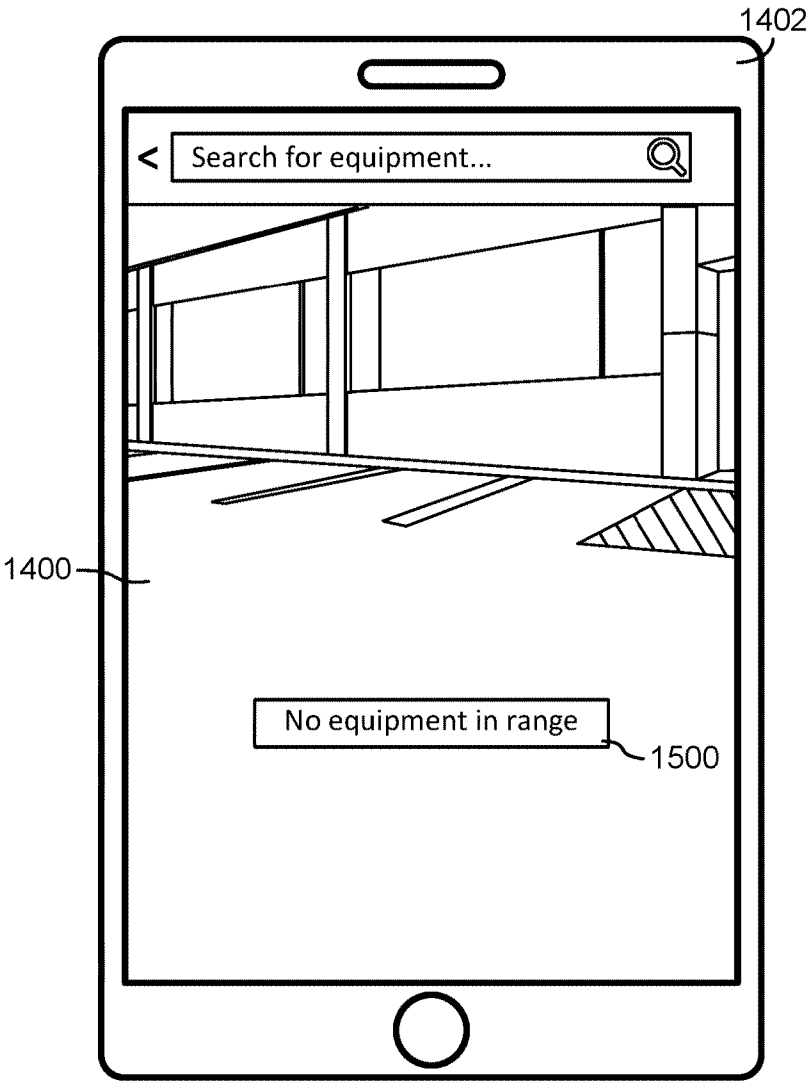
FIGS. 14-15 are images of a start screen for an application configured to display the locations of building equipment on a mobile device, according to an exemplary embodiment.
Figure 14:
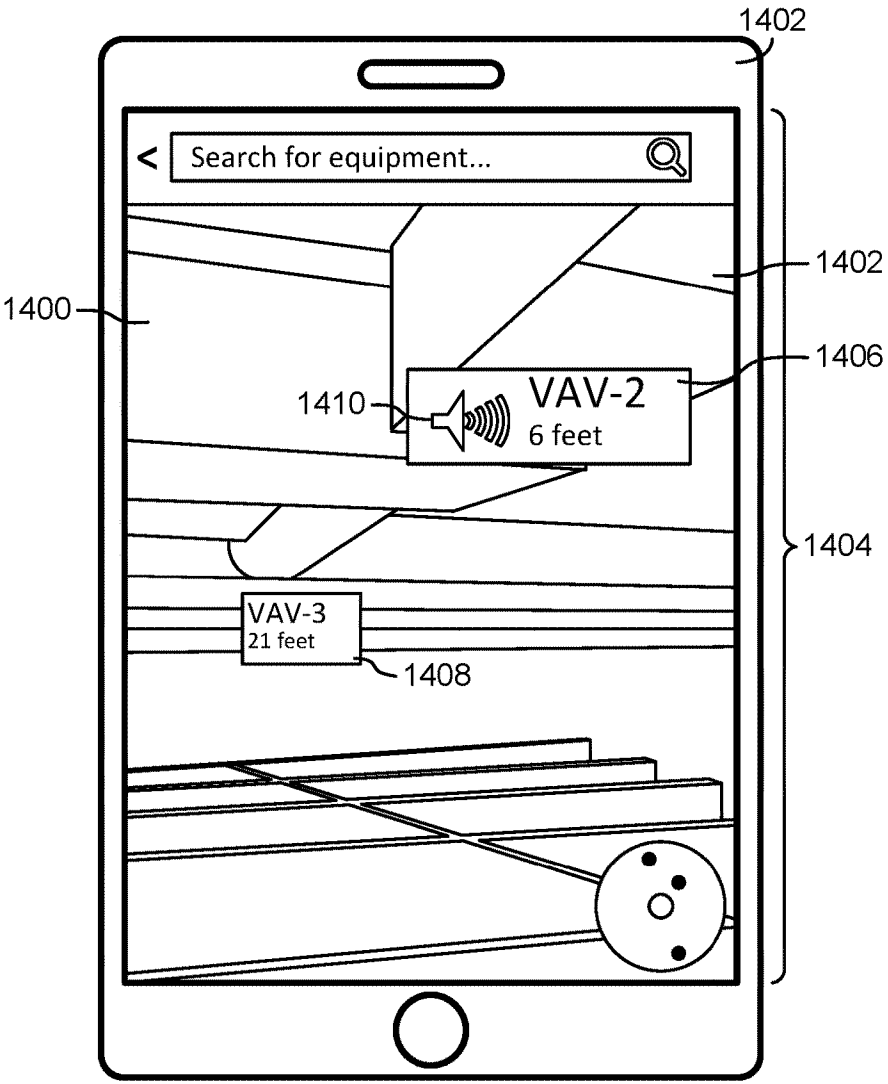

Referring particularly to FIGS. 14-15, a start screen 1400 displayed on a mobile device 1402 for the application is shown, according to one embodiment. In some embodiments, the application initially opens in augmented reality mode, in which the mobile device displays an augmented reality display 1404. The augmented reality display may include a camera-derived view of the building space within which the mobile device is located (e.g., using a camera integrated with the mobile device). If any BMS devices are within range of the mobile device, the augmented reality display 1404 may include an indication of where the BMS devices are located within the building space. For example, FIG. 14 shows a first VAV 1406 ("VAV-2") located within one air supply duct and a second VAV 1408 ("VAV-3") located within another air supply duct.

In some embodiments, the augmented reality display 1404 includes distances between the mobile device 1402 and a BMS devices. In some embodiments, the augmented reality display 1404 includes a sound icon 1410 associated with each BMS device. Selecting the sound icon may cause the associated BMS device to produce a sound or other indication to further guide the user toward the BMS device. If no BMS devices are within range of the mobile device, the augmented reality display may present a message 1500 that no equipment is within range (as shown in FIG. 15).

Figure 17:
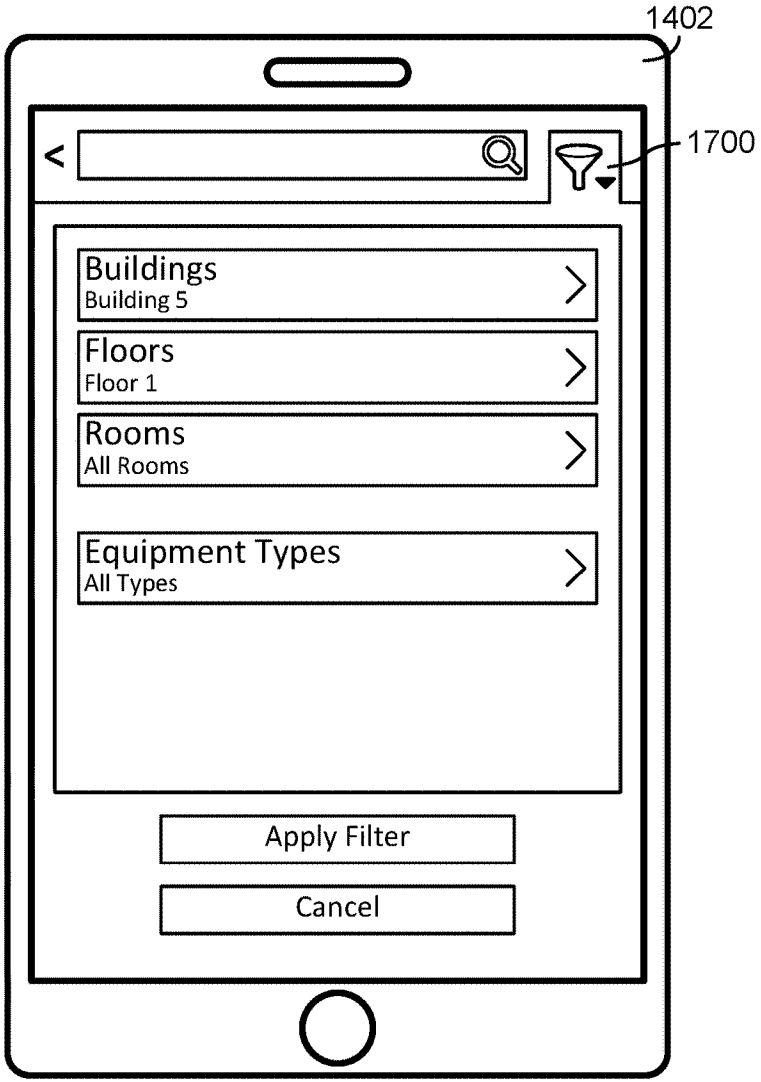
FIGS. 16-17 are images of an equipment searching interface which may be presented via the mobile device, according to an exemplary embodiment.
Figure 16:
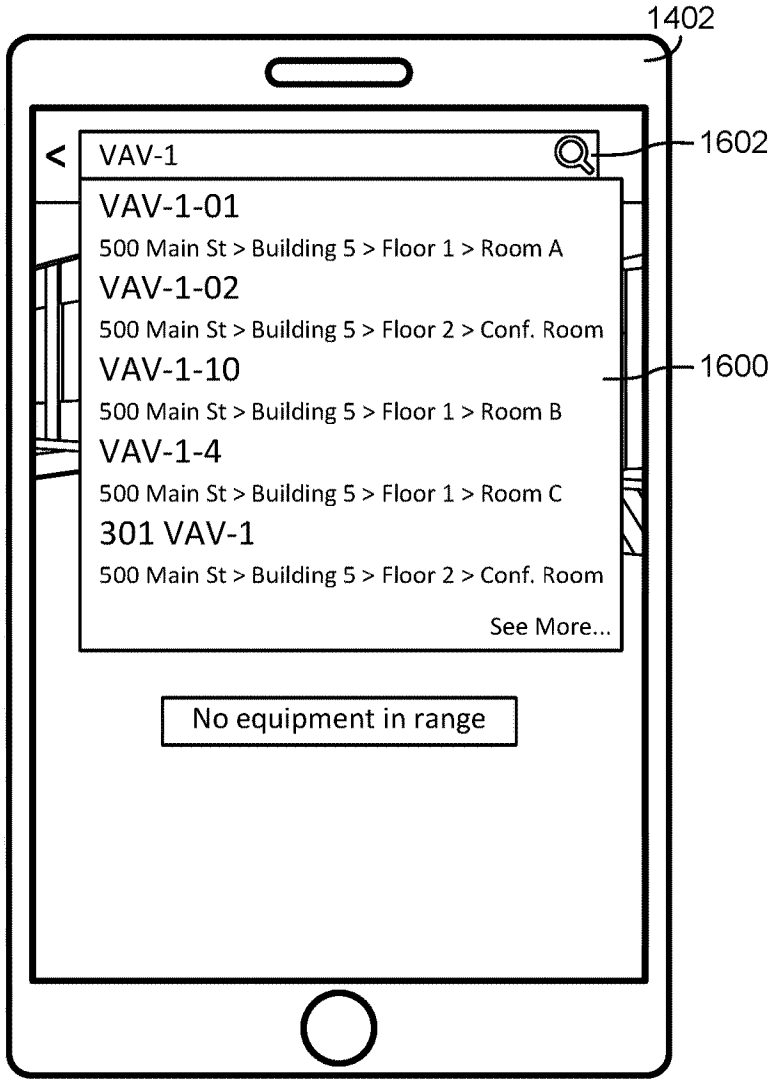

Referring now to FIGS. 16-17, an equipment searching interface 1600 is shown, according to one embodiment. The equipment searching interface 1600 may include a search field 1602 that allows a user to specify a device name, type, or other device-related parameters. For example, as shown in FIG. 16, a user can enter the text "VAV-1" into the search field 1602 to search for all BMS devices that have the text string "VAV-1" in their device names. In some embodiments, the searching interface 1600 allows a user to search by device type (e.g., chiller, VAV, fan, etc.) or any other attribute of the BMS devices. In some embodiments, the equipment searching interface 1600 allows the user to filter the set of searchable equipment by location (e.g., by building, by floor, by room, etc.) and/or by equipment type by selecting the filter icon 1700, as shown in FIG. 17. The equipment searching interface 1600 may communicate with a device locating system and/or a BMS controller to obtain a list of BMS devices that can be searched. The user can select a particular BMS device or set of BMS devices via the equipment searching interface.

Figure 19:
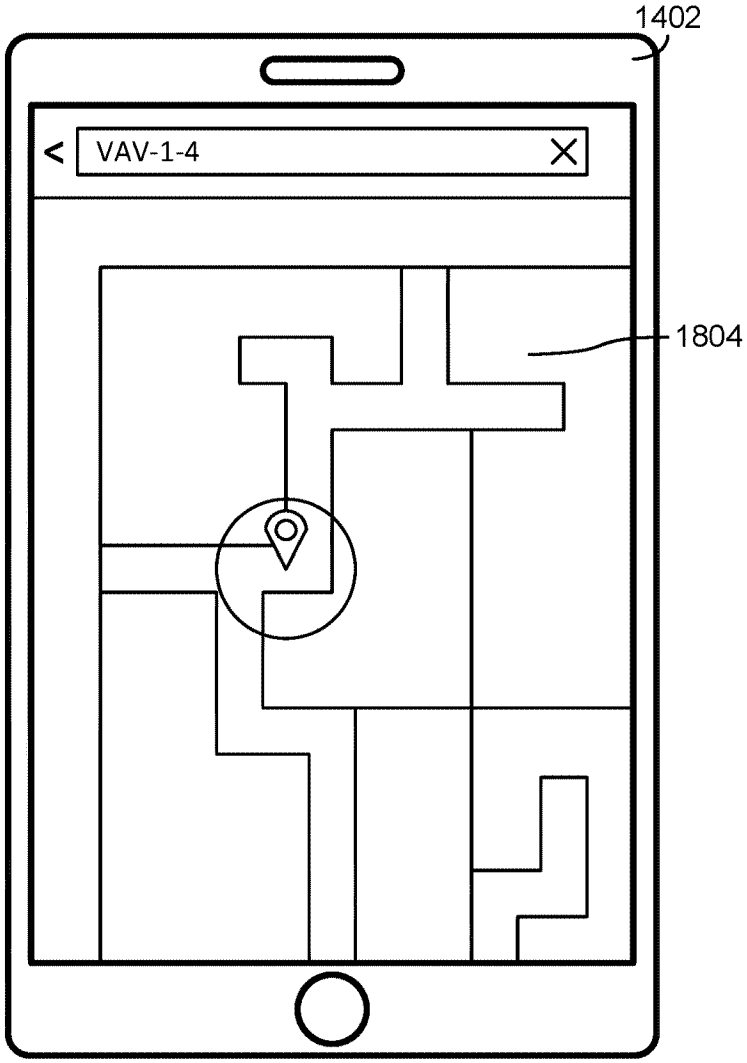
FIGS. 18-19 are images of a map display interface which may be presented via the mobile device, according to an exemplary embodiment.
Figure 18:
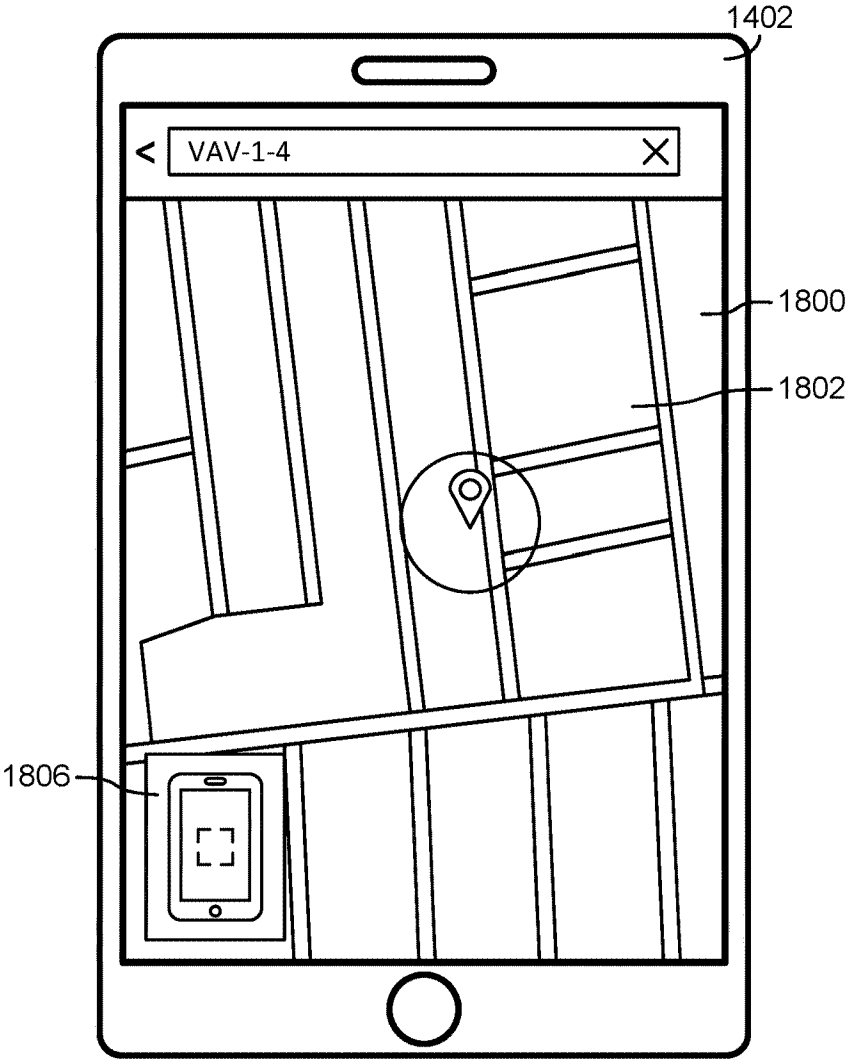

Referring now to FIGS. 18-19, a map display interface 1800 is shown, according to one embodiment. The map display interface 1800 may be presented in response to a user selecting a BMS device via the equipment searching interface 1600. The map display interface 1800 may display the location of the selected BMS device and the location of the mobile device 1402 on a street map 1802 (as shown in FIG. 18) and/or a building floorplan 1804 (as shown in FIG. 19). The street map 1802 may be displayed if the mobile device 1402 is not located in the same building as the selected BMS device. The floorplan 1804 may be displayed if the mobile device 1402 is located in the same building and/or on the same floor as the selected BMS device. The map display interface 1800 may obtain building floorplans 1804 from a device locating system and/or a BMS controller. The street maps 1802 may be obtained from any of a variety of sources (e.g., Google Maps, etc.).

The map display interface 1800 is shown to include an augmented reality icon 1806. When selected, the augmented reality icon 1806 may cause the user interface to switch to the augmented reality display 1404. The augmented reality icon 1806 may not be selectable if the mobile device 1402 is not in the same room as the selected BMS device (as shown in FIG. 18). When the mobile device is moved within a predetermined distance of the selected BMS device (e.g., in the same room), the augmented reality button 1806 may become selectable (as shown in FIG. 19).

Figure 20:
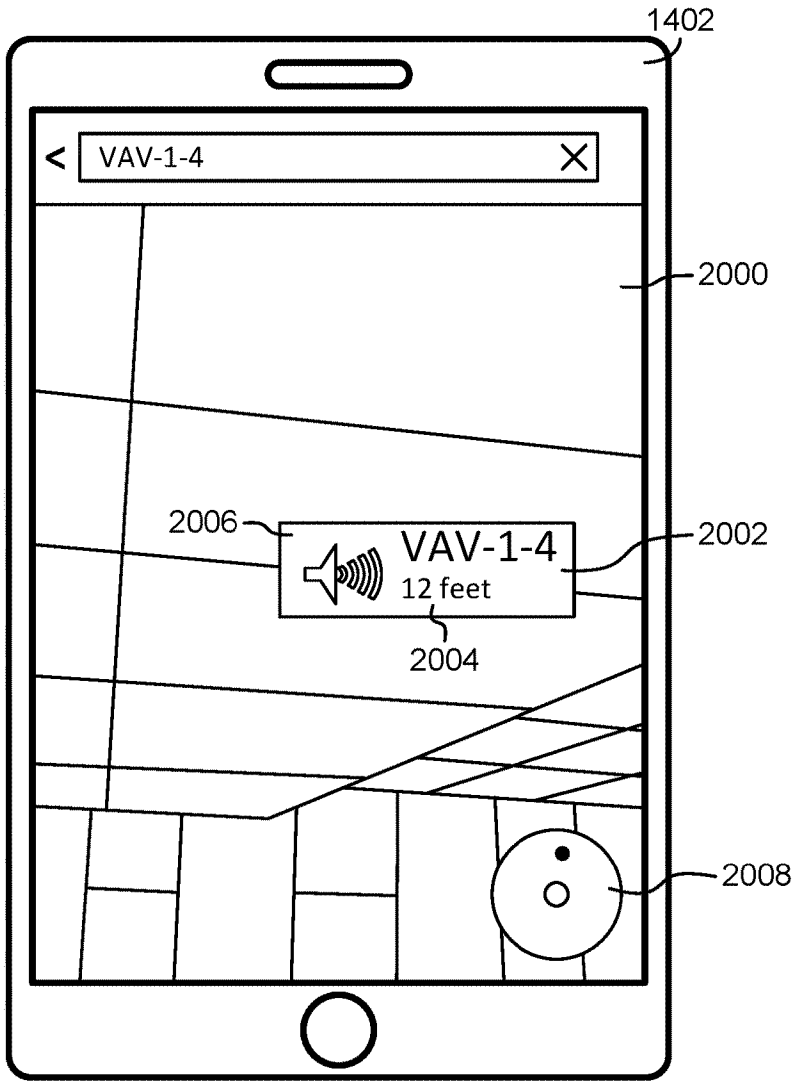
FIG. 20 is an image of an augmented reality interface which may be presented via the mobile device, according to an exemplary embodiment.

Referring now to FIG. 20, another image of the augmented reality display 1404 is shown, according to one embodiment. The augmented reality display 1404 includes a camera-derived view 2000 of the building space within which the mobile device 1402 is located (e.g., using a camera integrated with the mobile device). If any BMS devices are within range of the mobile device 1402, the augmented reality display 1404 may include an indication 2002 of where the BMS devices are located within the building space. For example, FIG. 20 shows a first VAV ("VAV-1-4") located within the ceiling of the building space.

In some embodiments, the augmented reality display 1404 includes a distance 2004 between the mobile device 1402 and a BMS device. In some embodiments, the augmented reality display 1404 includes a sound icon 2006 associated with the BMS device. Selecting the sound icon 2006 may cause the BMS device to produce a sound or other indication to further guide the user toward the BMS device. In some embodiments, the augmented reality display 1404 includes an interface element 2008 indicating the relative locations of nearby BMS devices, even if the BMS devices are not displayed in the camera-derived view 2000.

Figure 22:
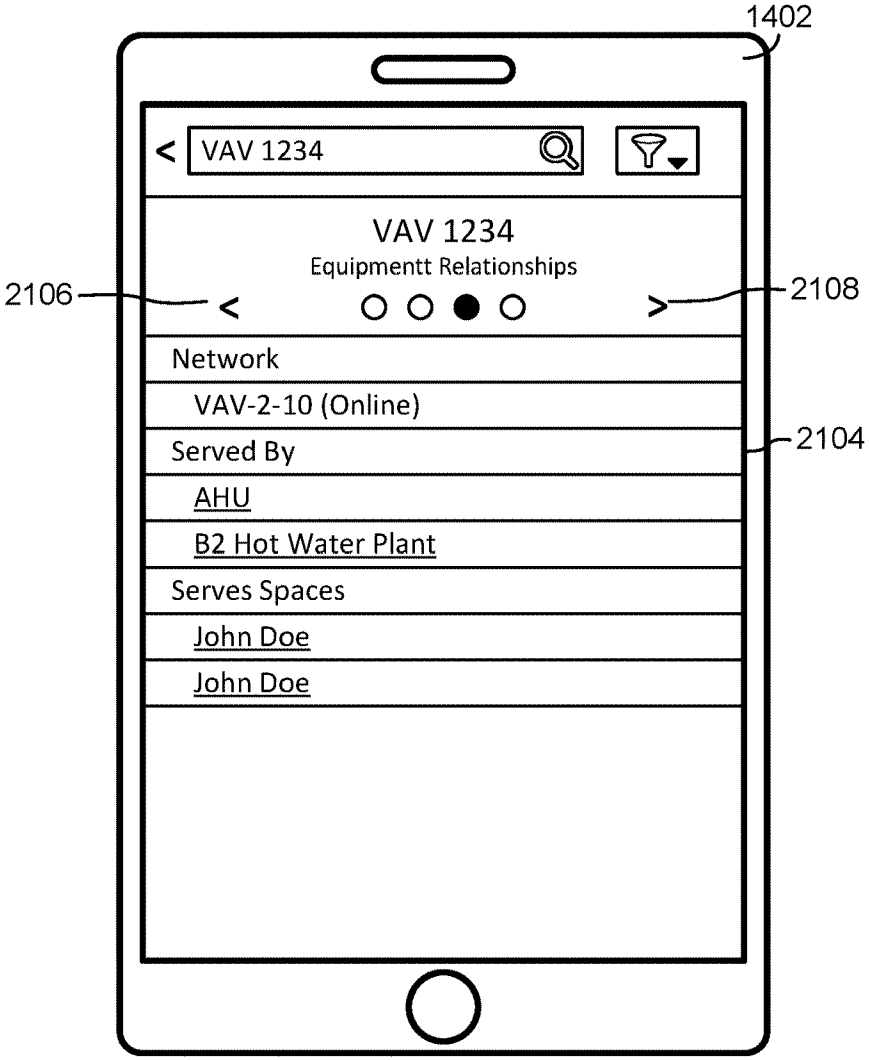
FIGS. 21-22 are images of a monitoring and control interface which may be presented via the mobile device, according to an exemplary embodiment.
Figure 21:
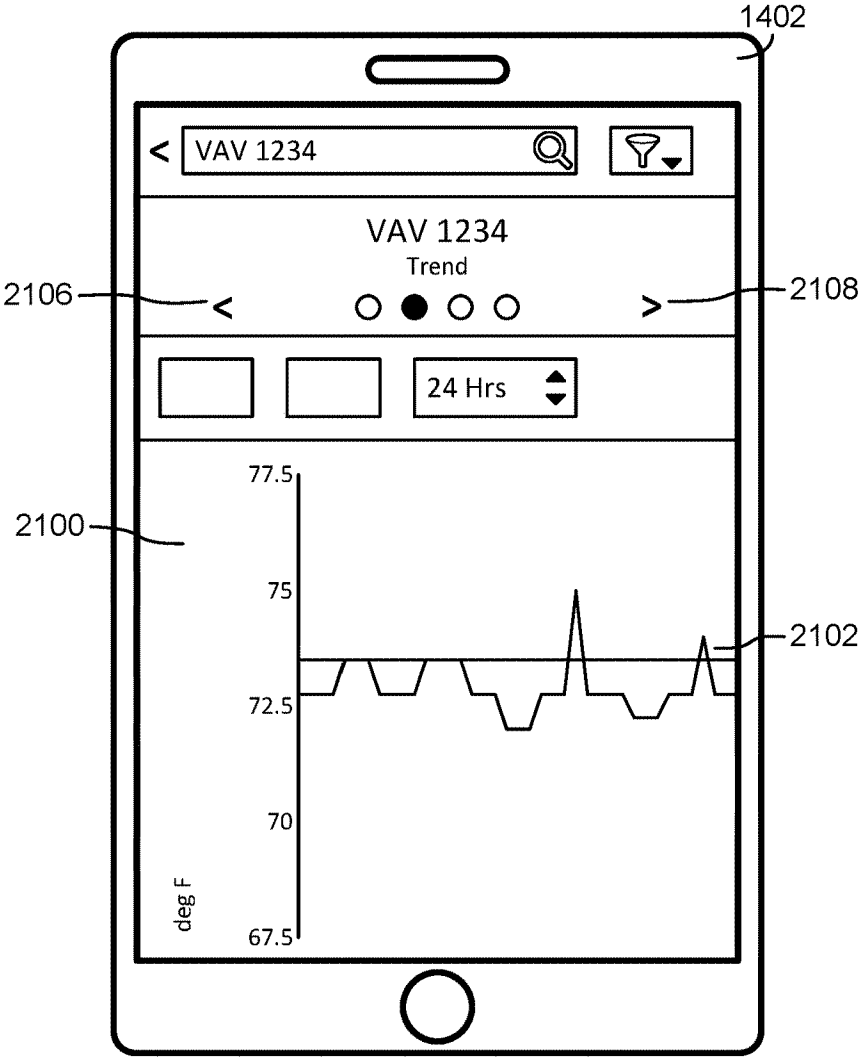

Referring now to FIGS. 21-22, a monitoring and control interface 2100 is shown, according to one embodiment. The monitoring and control interface 2100 may be configured to present data associated with a BMS device, perform diagnostics, send commands to the BMS device, and/or perform other monitoring/control functions. In some embodiments, the monitoring and control interface 2100 is configured to perform some or all of the monitoring and control operations described with reference to FIG. 12. The functionality available via the monitoring and control interface 2100 may be a function of the type of BMS device and/or the control options available for the BMS device. For example, a trend plot 2102 is shown in FIG. 21 displayed within the monitoring and control interface for a BMS device described as VAV 1234. FIG. 22 further shows an equipment relationship table 2104 displayed within the monitoring and control interface 2100 for the BMS device VAV 1234. In one embodiment, the user switches between the trend plot 2102 and the equipment relationship table 2104 by "swiping" right to left on the mobile device. Alternatively, the user can switch between the trend plot 2102 and the equipment relationship table 2104 by selecting the input arrows 2106, 2108.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A heating, ventilation, and air conditioning HVAC) system for installation in a building, the HVAC system including:

a mobile device comprising a camera;

an HVAC device, the HVAC device comprising a processing circuit, the processing circuit including a memory and a processor configured to execute instructions stored on the memory, wherein the processing circuit is configured to automatically determine a location of the HVAC device and report the location of the HVAC device to the mobile device; and a device locating system configured to determine that the HVAC device is hidden or obscured from the camera of the mobile device and to present an interface that displays: (i) the location of the HVAC device, and (ii) a distance between the location of the HVAC device and a location of the mobile device, after determining that the HVAC device is not seen from the camera of the mobile device.

2. The HVAC system of claim 1, wherein the processing circuit automatically sets control parameters for the HVAC device based on the location of the HVAC device.

3. The HVAC system of claim 1, the HVAC device further comprising a GPS device and an altimeter.

4. The HVAC system of claim 3, wherein the processing circuit receives location data from the GPS device and the altimeter, and determines a three dimensional location of the HVAC device within the building.

5. The HVAC system of claim 1, the HVAC device further comprising an emitter communications interface, the emitter communications interface configured to receive a wireless signal transmitted by one or more wireless emitters located at one or more building management system (BMS) devices in the building.

6. The HVAC system of claim 5, wherein the wireless signal is a Bluetooth low energy signal.

7. The HVAC system of claim 5, wherein the processing circuit determines the location of the HVAC device based on a signal strength of the wireless signal.

8. The HVAC system of claim 5, wherein the wireless signal includes an emitter identifier.

9. The HVAC system of claim 8, wherein the processing circuit determines the location of the HVAC device based on the emitter identifier in the wireless signal.

10. A system for locating building equipment in a building management system (BMS), the system comprising:

a mobile device comprising a communications interface configured to request a location of a BMS device and to determine location information of the mobile device, and at least one of a compass or an accelerometer, the at least one of the compass or accelerometer configured to determine orientation information of the mobile device; and a device locating system configured to identify the location of the BMS device, provide the location of the BMS device to the mobile device, and determine that the BMS device is hidden or obscured from a camera of the mobile device, and comprising an augmented reality module configured to receive the location information from the mobile device, receive the orientation information from the mobile device, establish a location of the mobile device based on the location information, and establish an orientation of the mobile device based on the orientation information;

wherein the mobile device is configured to present an interface that displays the location of the BMS device relative to the location of the mobile device and the orientation of the mobile device after determining that the BMS device is hidden or obscured from the camera of the mobile device.

11. The system of claim 10, wherein the interface is an augmented reality interface that overlays the location of the BMS device upon a camera-derived view of a building space from the camera of the mobile device.

12. The system of claim 11, wherein the mobile device is configured to display the augmented reality interface after determining that the mobile device is within a predetermined distance of the BMS device.

13. The system of claim 11, wherein the augmented reality interface comprises a distance indicator representing a distance between the mobile device and the BMS device.

14. The system of claim 11, wherein the augmented reality interface comprises an indication of a direction toward the BMS device from the camera of the mobile device.

15. The system of claim 11, wherein the augmented reality interface comprises a selectable icon that causes the BMS device to produce an audible or visible indication when the selectable icon is selected.

16. The system of claim 10, wherein the interface comprises a street map that includes both the location of the mobile device and the location of the BMS device marked on the street map.

17. The system of claim 16, wherein the mobile device is configured to display the street map after determining that the mobile device and the BMS device are not located within a same building.

18. The system of claim 10, wherein the interface comprises a floorplan that includes both the location of the mobile device and the location of the BMS device marked on the floorplan.

19. The system of claim 18, wherein the mobile device is configured to display the floorplan after determining that the mobile device and the BMS device are located within a same building.

20. The system of claim 10, wherein the interface comprises a monitoring and control interface configured to display at least one of diagnostic information, performance information, and control information for the BMS device.

21. A method for locating building equipment in a building management system (BMS) using a device locating system, the method comprising:

receiving, by the device locating system, a request for a location of a BMS device from a mobile device;

receiving, by the device locating system, location information of the mobile device;

determining, by the device locating system, a location of the mobile device based on the location information;

identifying, by the device locating system, a location of the BMS device;

determining, by the device locating system, a location of the BMS device relative to the location of the mobile device;

transmitting, by the device locating system, the location of the BMS device to the mobile device for display on an interface of the mobile device;

determining, by the device locating system, a distance between the location of the BMS device and the location of the mobile device;

determining, by the device locating system, that the BMS device is hidden or obscured from a camera of the mobile device; and displaying, by the device locating system, the distance and the location of the BMS device after determining that the BMS device is hidden or obscured from the camera of the mobile device.

* * * * *